US005581338A

United States Patent [19]

Nakamichi et al.

[11] Patent Number: 5,581,338

[45] Date of Patent: Dec. 3, 1996

[54] TONER IMAGE TRANSFERRING DEVICE INCLUDING TRANSFER CHARGER AND AC CHARGE ELIMINATOR CRYSTAL DISPLAY DEVICE

[75] Inventors: Kiyoshi Nakamichi, Hyogo; Hideyuki Nanba; Kenji Fuke, both of Kanagawa; Yoshito Hukata, Hyogo, all of Japan

[73] Assignee: Fujitsu Limited, Kawasaki, Japan

[21] Appl. No.: 370,562

[22] Filed: Jan. 9, 1995

Related U.S. Application Data

[63] Continuation of Ser. No. 21,580, Feb. 24, 1993, abandoned.

[30] Foreign Application Priority Data

| | | | |
|---|---|---|---|
| Feb. 24, 1992 | [JP] | Japan | 4-036124 |
| Feb. 28, 1992 | [JP] | Japan | 4-042934 |
| May 13, 1992 | [JP] | Japan | 4-120403 |
| May 13, 1992 | [JP] | Japan | 4-120404 |
| Jun. 29, 1992 | [JP] | Japan | 4-170493 |

[51] Int. Cl.[6] ..... G03G 15/14; G03G 21/00

[52] U.S. Cl. ..... 355/274; 355/315

[58] Field of Search ..... 355/271, 274, 355/276, 315

[56] References Cited

U.S. PATENT DOCUMENTS

| | | | |
|---|---|---|---|
| 4,017,169 | 4/1977 | Komura et al. | 355/274 |
| 4,116,556 | 9/1978 | Tanaka et al. | 355/274 X |
| 4,260,240 | 4/1981 | Pieper | 355/274 X |
| 4,466,729 | 8/1984 | Iwata | 355/274 X |
| 4,469,428 | 9/1984 | Yoshioka et al. | 355/274 X |
| 4,673,280 | 6/1987 | Milton | 355/274 |
| 4,827,308 | 5/1989 | Howard et al. | 355/274 X |
| 4,882,606 | 11/1989 | Deguchi | 355/274 |
| 4,903,080 | 2/1990 | Taniguchi | 355/274 |
| 5,040,028 | 8/1991 | Kamimura et al. | 355/275 |
| 5,126,796 | 6/1992 | Fujii et al. | 355/274 X |
| 5,130,752 | 7/1992 | Morishita et al. | 355/274 |
| 5,200,784 | 4/1993 | Kimura et al. | 355/274 |

FOREIGN PATENT DOCUMENTS

| | | |
|---|---|---|
| 449470A2 | 10/1991 | European Pat. Off. . |
| 59-15958 | 1/1984 | Japan . |
| 63-282769 | 11/1988 | Japan . |
| 63-298268 | 12/1988 | Japan . |

OTHER PUBLICATIONS

*Patent Abstracts of Japan,* JP-59-15958, P-274, dated May 17, 1984, vol. 8, No. 15.

*Patent Abstracts of Japan,* JP-63-298268, P-848, dated Mar. 29, 1989, vol. 13, No. 127.

*Patent Abstracts of Japan,* JP-63-282769, P-841, dated Mar. 10, 1989, vol. 13, No. 102.

*Patent Abstracts of Japan,* JP-1-13571, P-866, dated May 8, 1989, vol. 13, No. 188.

*Patent Abstracts of Japan,* JP-1-292380, P-1005, dated Feb. 13, 1990, vol. 14, No. 76.

*Patent Abstracts of Japan,* JP-62-178288, P-659, dated Jan. 26, 1988, vol. 12, No. 25.

*Primary Examiner*—Fred L. Braun

*Attorney, Agent, or Firm*—Staas & Halsey

[57] ABSTRACT

A toner image transferring device is used to electrostatically transfer a charged toner image from a roller to a sheet of paper. The device includes a transfer charger for giving the paper an electric charge. A charge eliminator is located next to the roller for partially eliminating the electric charge from the paper. The charge eliminator is positioned to be adjacent to the paper and the roller, but displaced from the transfer charger. Paper passes through the device such that the paper is in contact with the roller when passing over the transfer charger, thereby optimizing the transfer of the toner image from the roller to the paper.

22 Claims, 15 Drawing Sheets

TONER IMAGE TRANSFERRING DEVICE INCLUDING TRANSFER CHARGER AND AC CHARGE ELIMINATOR CRYSTAL DISPLAY DEVICE

This application is a continuation of application Ser. No. 08/021,580, filed Feb. 24, 1993, now abandoned.

BACKGROUND OF THE INVENTION

1) Field of the Invention

The present invention generally relates to an image formation apparatus including a toner image carrying body such as a photosensitive drum, a dielectric drum or the like to which a toner image obtained from toner development of an electrostatic latent image is electrostatically adhered and held, and in particular, relates to a toner image transferring device incorporated therein for electrostatically transferring the toner image from the toner image carrying body to a sheet of paper.

2) Description of the Related Art

As a representative of an image formation apparatus as mentioned above, an electrophotographic recording apparatus is well known, wherein the following processes are typically carried out:

a) a uniform distribution of electrical charges is produced on a surface of an electrostatic latent image carrying body;

b) an electrostatic latent image is formed on a charged area of the body surface by an optical writing means such as a laser beam scanner, an LED (light emitting diode) array, a liquid crystal shutter array or the like;

c) the latent image is developed as a visible image with a developer or toner, which is electrically charged to be electrostatically adhered to the latent image zone;

d) the developed and charged toner image is electrostatically transferred from the body to a recording medium such as a cut sheet paper; and e) the transferred toner image is fixed and recorded on the cut sheet paper by a toner image fixing means such as a heat roller.

Typically, the electrostatic latent image carrying body may be an electrophotographic photoreceptor, usually formed as a drum, called a photosensitive drum, having a cylindrical conductive substrate formed of a metal such as aluminum, and a photoconductive insulating film bonded to a cylindrical surface thereof and formed of an organic photoconductor (OPC), a selenium photoconductor or the like.

In the transferring process, the transfer of the toner image to the paper is carried out by using a transfer charger to feed an electric charge to the paper. In particular, the transfer charger is disposed in the vicinity of the photosensitive drum, the paper is introduced into a clearance therebetween, and the transfer charger gives the paper an electric charge having a polarity opposite to that of the electric charge of the toner image, whereby the toner image is electrostatically transferred from the drum to the paper. For example, the transfer charger may be a corona discharger.

To increase the efficiency of the transfer of the toner image, the paper must be given a sufficient amount of electric charge. Of course, the transfer charger is designed so as to be provided with a capacity needed to give the paper the sufficient amount of electric charge, but the transfer charger must be properly positioned with respect to the photosensitive drum before a desired efficiency of the transfer of the toner image can be obtained.

During the transferring process, the paper is adhered to the photosensitive drum due to an electrostatic attraction acting therebetween, and thus the paper can often be entangled with the drum. Thus, conventionally, for example, a pair of wedge-shaped separating members are provided at an exit of the clearance between the photosensitive drum and the transferring device to be engaged with a surface of the drum at the side edges thereof, so that the leading edge of the paper is mechanically separated therefrom. Alternatively, the transferring device includes an AC charge eliminator integrally associated with the transfer charger. The AC charge eliminator may comprise a corona discharger which is energized with an alternating current, whereby the charge is partially eliminated from the paper to which the toner image has been transferred. Thus, the electrostatic attraction between the photosensitive drum and the paper is weakened so that the paper can be easily separated from the drum, but the AC charge eliminator must be properly positioned with the drum before the separation of the paper from the drum can be surely ensured.

Conventionally, the association of the transfer charger with the AC charge eliminator involves an incompatibility in that the respective proper positions therefor interfere with each other. Namely, for example, when the transfer charger is properly positioned with respect to the photosensitive drum, the ability of the AC charge eliminator cannot be exhibited, and vice versa.

Also, an area or clearance between the toner image transferring device and the photosensitive drum must be kept constant before a stable transferring process can be ensured. Nevertheless, it is difficult to maintain the clearance between the toner image transferring device and the photosensitive drum because the drum cannot have a perfect circular profile. Accordingly, although the transferring device is positioned in place with respect to the drum, the clearance therebetween varies during the rotation of the drum. To maintain the clearance between the transferring device and the drum, the transferring device is provided with spacer rollers, and is resiliently biased toward the drum so that the spacer rollers thereof are resiliently pressed against a rotating surface of the drum, to thereby keep the clearance therebetween constant. To this end, conventionally, a printing unit including the photosensitive drum and the transferring device is frequently constituted as an integrated unit. However, this integrated unit is undesirable considering maintenance thereof, because manual access to an interior of the integrated unit is very difficult. Also, when a jamming of paper in the integrated unit occurs, removal of the jammed paper therefrom is very troublesome.

SUMMARY OF THE INVENTION

Therefore, an object of the present invention is to provide a toner image transferring device including a transfer charger, and an AC charge eliminator integrally associated therewith, which is constituted such that an incompatibility involved in the association of the transfer charger with the AC charge eliminator can be resolved.

Another object of the present invention is to provide an arrangement of a toner image transferring device and a photosensitive drum wherein not only can an establishment of constant clearance between the transferring device and the drum be ensured, but also an easy access for maintenance of the transferring device and the drum is possible.

In accordance with a first aspect of the present invention, there is provided to a toner image transferring device

BRIEF DESCRIPTION OF THE DRAWINGS

Other objects and advantages of the present invention will be better understood from the following description, with reference to the accompanying drawings, in which:

FIG. 3(*b*) is a schematic and diagrammatic view showing another positional relationship between a transferring device and a photosensitive drum;

DESCRIPTION OF THE PREFERRED EMBODIMENTS

Figure 1:
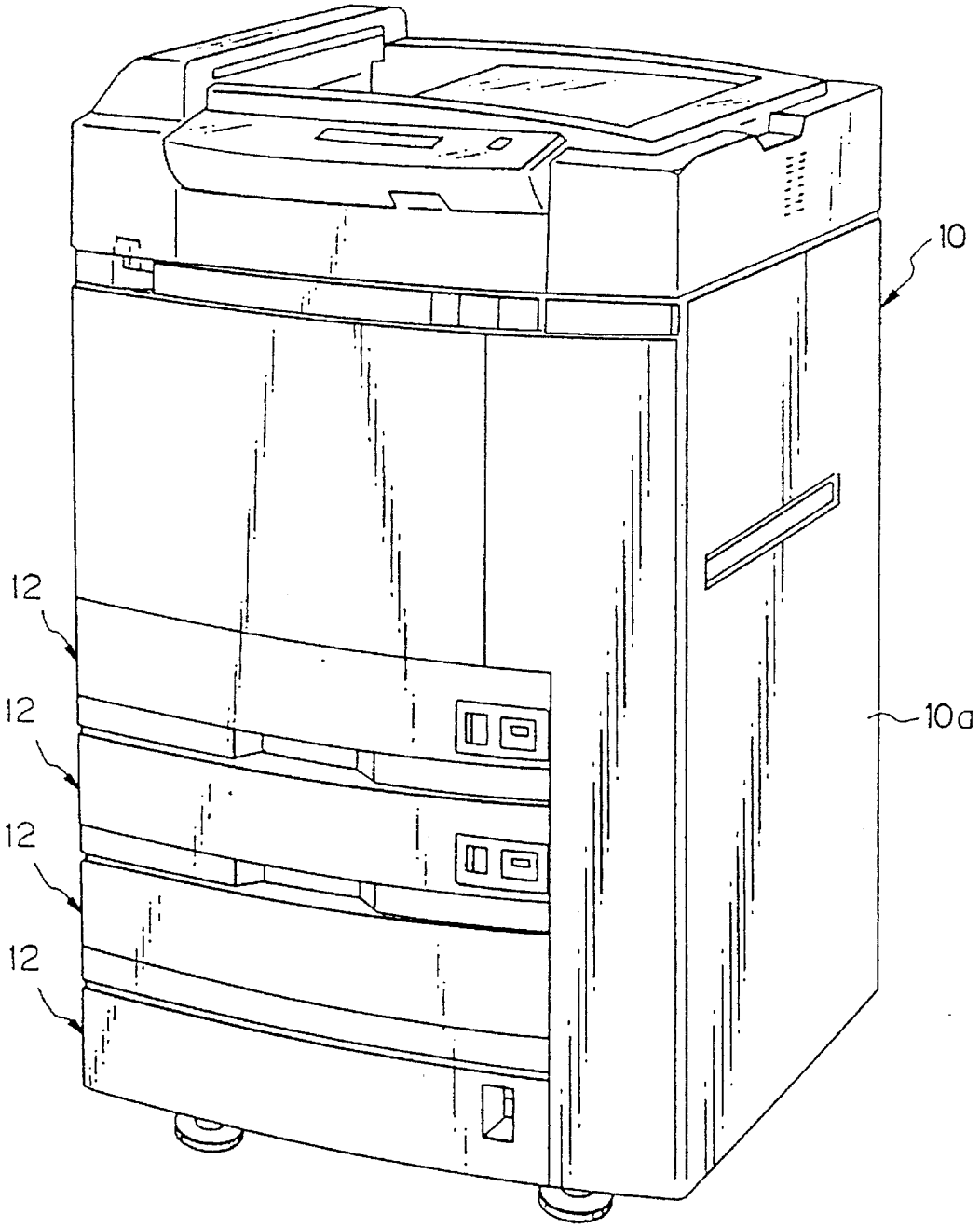
FIG. 1 is a perspective view of an appearance of an electrophotographic laser printer having a toner image transferring device constituted according to a first aspect of the present invention.
Figure 2:
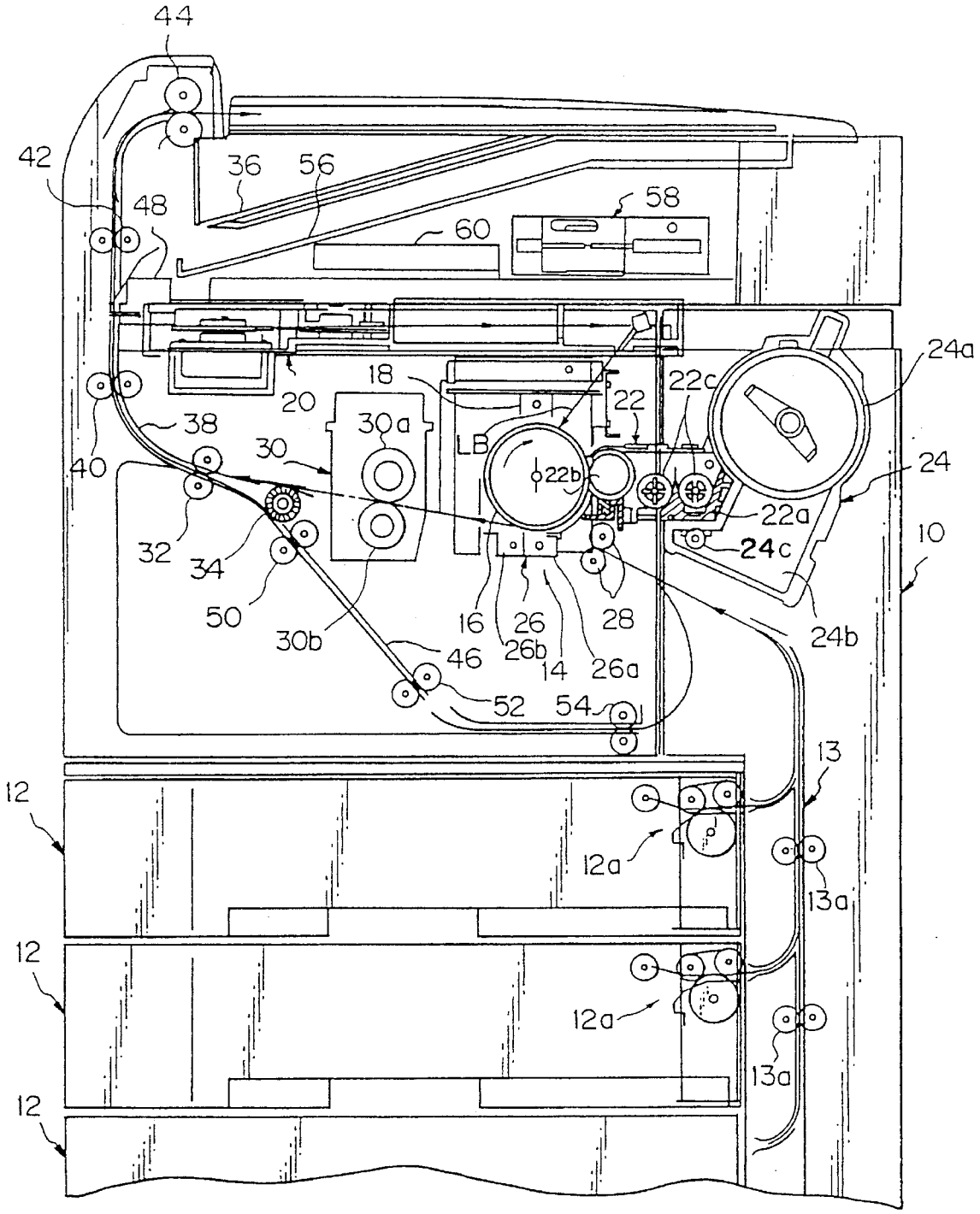
FIG. 2 is a schematic view showing an interior arrangement of the laser printer as shown in FIG. 1.

FIG. 1 shows an appearance of an office use type printer as an example of an electrophotographic laser printer, in which the present invention is embodied, and FIG. 2 schematically shows an interior arrangement of the printer shown in FIG. 1. This printer comprises a printer housing 10, and four paper cassettes 12 incorporated therein, each of which receives a stack of cut sheet paper having a given paper size, and a printing unit 14 provided in the housing 10. The printing unit 14 prints on a cut sheet paper selectively fed from one of the paper cassettes 12 through a paper guide 13 extended between the printing unit 14 and the paper cassettes 12.

The printing unit 14 comprises a rotary photosensitive drum 16 formed as a latent image carrying body and rotated in a direction indicated by an arrow in FIG. 2 during an operation of the printer. The drum 16 may be made of an aluminum cylindrical hollow member and a photoconductive insulating film bonded to a cylindrical surface thereof. The photoconductive insulating film may be made of a selenium photoconductor, organic photoconductor (OPC), amorphous silicone photoconductor (a-Si).

The printing unit 14 also comprises an electric discharger 18 such as a corona discharger for producing a charged area on the photosensitive drum 16, and a laser beam scanner 20 is provided to write an electric latent image on the charged area of the drum 16. The laser beam scanner 20 includes a laser source such as a semiconductor laser diode for emitting a laser light, an optical system for focusing the laser light into a laser beam LB, and an optical scanning system such as a polygon mirror for deflecting the laser beam LB along a direction of a central axis of the drum 16 so that the charged area of the drum 16 is scanned by the deflecting laser beam LB. During the scanning, the laser beam LB is switched on and off on the basis of binary image data obtained from, for example, a word processor, computer or the like, so that an electrostatic latent image is written as a dot image on the charged area of the drum 16. In particular, when a zone of the charged area is irradiated by the laser beam LB, the charges are released from the irradiated zone so that the latent image is formed as a potential difference between the irradiated zone and the remaining zone.

The printing unit 14 further comprises a developing device 22 for electrostatically developing the latent image with, for example, a two-component type developer composed of a toner component (colored fine resin particles) and a magnetic component (magnetic fine carriers). The developing device 22 includes a vessel 22*a* for holding the developer, a magnetic developing roller provided 22*b* provided in the vessel 22*a* such that a portion of the developing roller is exposed therefrom and faces the surface of the photosensitive drum 16, and a pair of screw type agitators 22*c* for agitating and circulating the developer held in the vessel 22*a*. The developer is agitated so that the toner particles are electrically charged with a given polarity by a triboelectrification with the magnetic carriers, and the development of the latent image is carried out by an electrostatic attraction of the charged toner particles to the latent image. The magnetic carriers with the toner particles are magnetically adhered to the surface of the magnetic roller 22*b* to form a magnetic brush therearound, and by rotating the magnetic roller 22*b* carrying the magnetic brush, the toner particle are brought to a developing zone between the magnetic roller 22*b* and the drum 16 for development of an electrostatic latent image formed on the drum 16. In the developing process, a developing bias voltage is applied to the magnetic roller 22*b* so that the toner particles carried to the developing zone are electrostatically attracted to only the latent image, whereby the toner development of the latent image is carried out.

During an operation of the printer, the toner component of the developer is consumed for the development of the latent image, and the magnetic carriers thereof are gradually deteriorated. For this reason, the developing device 22 can be provided with a cartridge type developer supplier 24 having a developer tank 24*a* and an empty tank 24*b*. An interior of the developer tank is divided into two chambers: one chamber, or developer chamber, holds a fresh developer composed of a toner component and a magnetic component; the other chamber, or toner chamber, holds only a toner component or supplemental toner. When a developer held in the vessel 22*a*, and therefore the magnetic component thereof, is deteriorated, a new developer supplier is exchanged for the old developer supplier. In particular, first, a movable door 10*a* (FIG. 1) of the printer housing 10 is opened to access the old developer supplier. After the old developer supplier is detached from the developing device 22, the new developer supplier is attached to the developing device 22. Then, an outlet port provided in bottom of the vessel 22*a* is opened, and the deteriorated developer is discharged from the vessel 22*a* into the empty tank 24*b* through the opened outlet port by driving the agitators 22*c*, and this discharge of the developer is facilitated by a paddle roller 24*c* provided in the empty tank 24*b*. After the discharge of the developer is completed, said outlet port is closed, and the fresh developer is introduced from the developer chamber of the tank 24*a*. Thereafter, during an operation of the printer, a part of the supplemental toner is fed from the toner chamber of the tank 24*a* to the vessel 22*a*.

Furthermore, the printer comprises a toner image transferring device 26 for electrostatically transferring the developed toner image from the photosensitive drum 16 to a cut sheet paper, which is introduced into a clearance between the drum 16 and the transferring device 26. The transferring device 26 includes a transfer charger 26*a*, and an AC charge eliminator 26*b* associated with and disposed adjacent to the transfer charger 26*a*. The transfer charger 26*a*, which may be a corona discharger, is subjected to an application of a DC electric energy to give the paper an electric charge having a polarity opposite to that of the electric charge of the developed toner image, whereby the toner image is electrostatically transferred from the drum 16 to the paper. The AC charge eliminator 26*b*, which also may be a corona discharger, is subjected to an application of an AC electric energy to partially eliminate the electric charge of the paper to which the toner image is transferred, whereby an electrostatic attraction acting between the paper and the drum 16 can be weakened for an effective separation of the paper from the drum 16. Note, the transferring device 26 is constituted according to the present invention, as stated hereinafter in detail.

As mentioned above, the cut sheet paper is selectively fed from one of the paper cassettes 12 to the printing unit 14, and the feeding of the paper is carried out by a feeder roller assembly 12*a* provided in each of the paper cassettes 12, and by pairs of feeder rollers 13*a* provided in the paper guide 13. When the leading edge of the fed paper reaches a pair of register rollers 28 and 28 associated with the printing unit 14, it is stopped once, and is then introduced, at a given timing, into the clearance between the drum 16 and the transferring device 26, so that the developed toner image can be transferred to the paper in place.

The paper discharged from the clearance between the drum 16 and the transferring device 26, i.e., the paper carrying the transferred toner image, is then moved toward a toner image fixing device 30, and is passed through a nip between a heat roller 30*a* and a backup roller 30*b* of the fixing device 30, whereby the transferred toner image is thermally fused and fixed on the paper. The paper having the fixed toner image is moved from the fixing device 30 toward a pair of paper feeder rollers 32 through a bladed roller 34 provided therebetween, and is then fed toward a paper receiver 36 provided at the top of the housing 10, through a paper guide 38 extended from the pair of paper feeder rollers 32 thereto. As shown in FIG. 2, the paper guide 38 is provided with two pair of paper feeder rollers 40 and 42 incorporated therein, and a pair of paper discharging rollers 44 provided at an exit end thereof, to thereby discharge the paper from the paper guide 38 to the paper receiver 36.

The printer is constituted such that printing can be done on both side faces of a cut sheet paper. To this end, the paper guide 38 includes a paper bypass guide 46 extended from a location adjacent to the bladed roller 34 to a location adjacent to a paper-entrance side of the register rollers 28, and is provided with a paper switch 48 incorporated therein between the paper feeder rollers 40 and 42. The paper bypass guide 46 is provided with three pairs of paper feeder rollers 50, 52 and 54 incorporated therein. On the other hand, the housing 10 is provided with a provisional paper receiver 56 provided below the paper receiver 36. When double-sided printing is performed, a paper discharged from the fixing device 30, i.e., a paper having printing on one side face thereof is once introduced into the provisional paper receiver 50 by actuating the paper switch 48. Just after the trailing edge of the paper clears a vertical plane passing through a longitudinal axis of the blade roller 34, the paper feeder rollers 32 and 40 are stopped once, so that the trailing edge of the paper is directed to the paper bypass guide 46 by the blades of the bladed roll 34 rotated in the counterclockwise direction in FIG. 2. Then, the paper feeder rollers 32 and 40 are reversely driven so that the leading edge of the paper, which is just previously defined as the trailing edge thereof, is introduced into the paper bypass guide 46, and is then returned to the register rollers 28 therethrough by the paper feeder rollers 50, 52 and 54 for printing on the other side face thereof. Thereafter, the paper having the printing on both side faces thereof is discharged from the paper discharging rollers 44 to the paper receiver 36 through the paper guide 38.

Note, in FIG. 2, reference 58 indicates a floppy disk driver for reading out code data from a floppy disk loaded therein, and reference 60 indicates a controller for controlling an operation of the printer. The code data read out from a floppy disk by the driver 58 is processed by the controller 60 to be converted into image data, on the basis of which printing is carried out.

Figure 3:
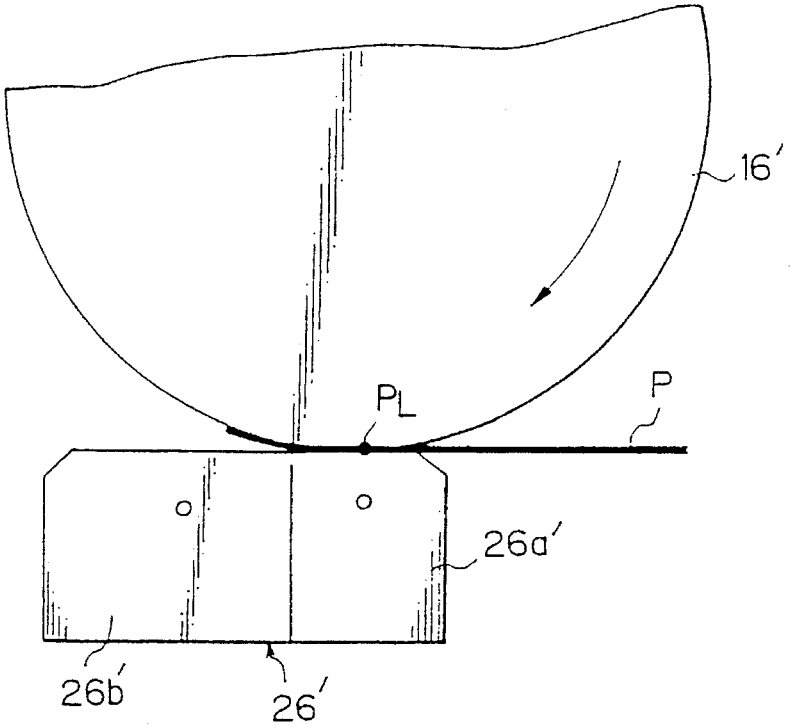
FIG. 3(*a*) is a schematic and diagrammatic view showing a positional relationship between a transferring device and a photosensitive drum.
Figure 3:
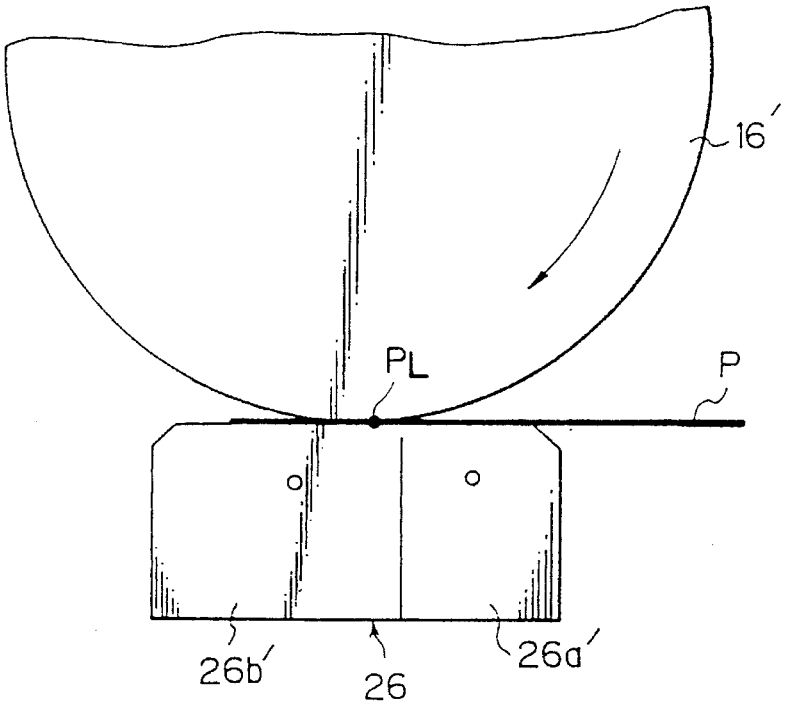

FIGS. 3(*a*) and 3(*b*) show a positional relationship between a photosensitive drum 16' and a toner image transferring device 26' including a transfer charger 26*a*' and an AC charge eliminator 26*b*' integrally associated therewith. In the case shown in FIG. 3(*a*), the transferring device 26' is positioned with respect to the drum 16' so that the transfer charger 26*a*' is displaced just below a zone in which a paper P is in contact with the drum 16'. Accordingly, a desired efficiency of a transfer of a toner image from the drum 16' to the paper P can be obtained. Nevertheless, the AC charge eliminator 26*b*' cannot sufficiently exhibit the ability thereof, and thus an elimination of the charge from the paper P is incomplete, so that the leading edge of the paper P is often adhered to the drum 16' due to an electrostatic attraction acting therebetween, as shown in FIG. 3(*a*). On the contrary, in case shown in FIG. 3(*b*), the transferring device 26' is positioned with respect to the drum 16' so that the AC charge eliminator 26*b*' is closer to the zone in which the paper P is in contact with the drum 16'. Accordingly, the AC charge eliminator 26b' can sufficiently exhibit the ability thereof, so that the leading edge of the paper P can be separated from the drum 16'. Nevertheless, since the transfer charger 26a' is away from the zone in which the paper P is in contact with the drum 16', a desired efficiency of a transfer of a toner image from the drum 16' to the paper P cannot be obtained. In other words photosensitive drum 16' can be described as having a contact zone which contacts a sheet of paper when the sheet of paper is passed through the toner image transferring device 26' and 26. The contact zone has a lowest point $P_L$ thereon. The positioning of the AC charge eliminator 26b' and the transfer charger 26a' can then be described in relation to the lowest point $P_L$.

Figure 4:
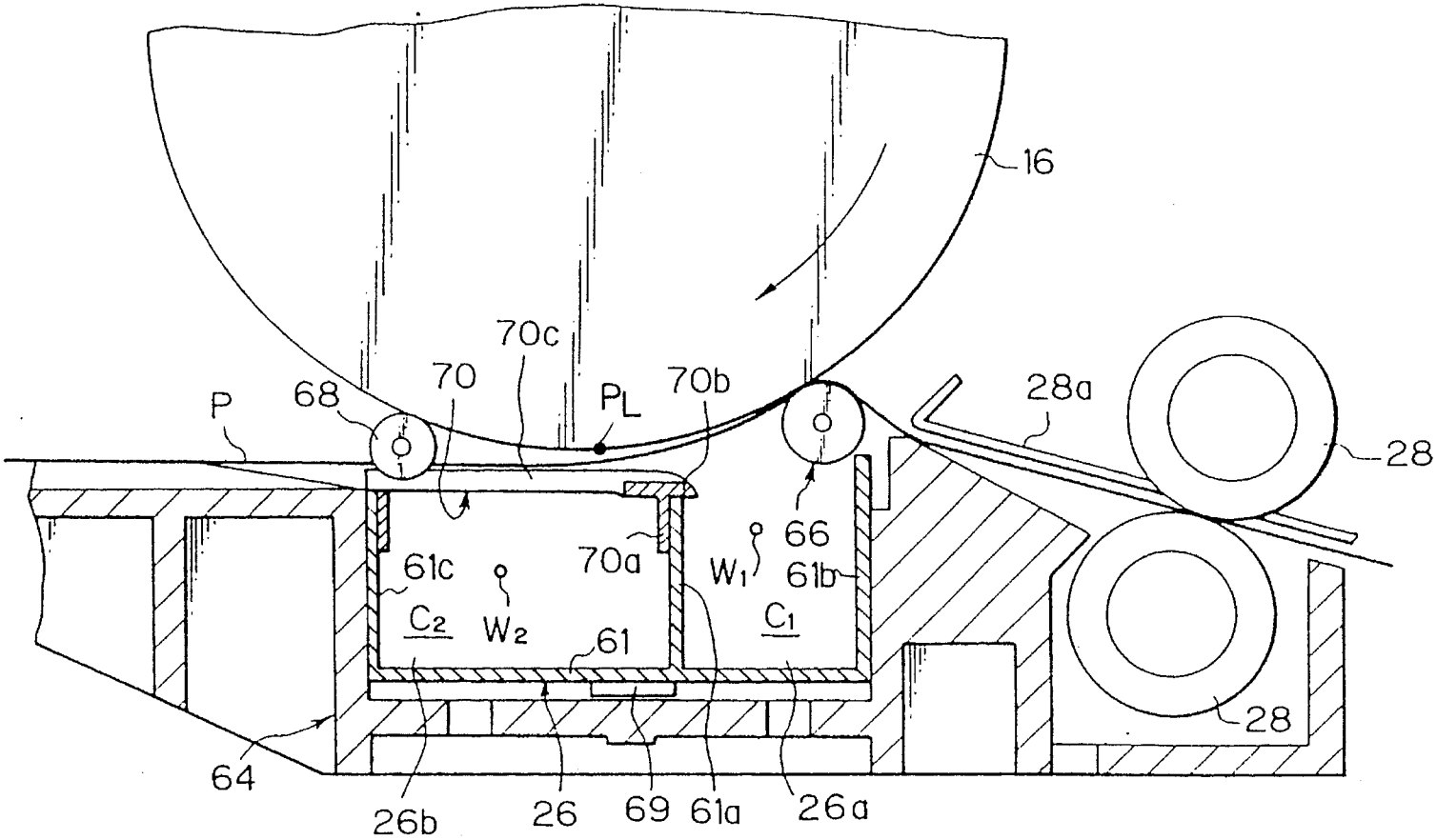
FIG. 4 is a partially-sectional and enlarged view showing a first embodiment of the toner image transferring device according to a first aspect of the present invention.

FIG. 4 shows a first embodiment of the toner image transferring device 26 constituted according to a first aspect of the present invention. As mentioned above, the transfer charger 26a and the AC charge eliminator 26b are integrally associated with each other. In particular, the transferring device 26 has an elongated box-like casing 61, an interior of which is divided into two chambers $C_1$ and $C_2$ by a middle partition wall 61a extended between the shorter side walls (not shown in FIG. 4) of the casing 61. Namely, the chamber $C_1$ is defined by the partition wall 61a and one (61b) of the longer side walls 61b and 61c of the casing 61, and the chamber $C_2$ is defined by the partition wall 61a and the other longer side wall 61c thereof. The casing 61 may be made of a suitable metal material such as stainless steel. A shown in FIG. 4, two electric wires $W_1$ and $W_2$ are longitudinally extended in the chambers $C_1$ and $C_2$, respectively. Of course, the wire $W_1$ forms a part of the transfer charger 26a, and is connected to a suitable DC current source (not shown), whereas the wire $W_2$ forms a part of the AC charge eliminator 26b, and is connected to a suitable AC current source (not shown). The casing 61 of the transferring device 26 is received in a recess 62 formed in a frame 64 of the printer, and is positioned with respect to the photosensitive drum 16 so that the AC charge eliminator 26b is close to a location just below the drum 16, but the transfer charger 26a is away from said location.

Figure 5:
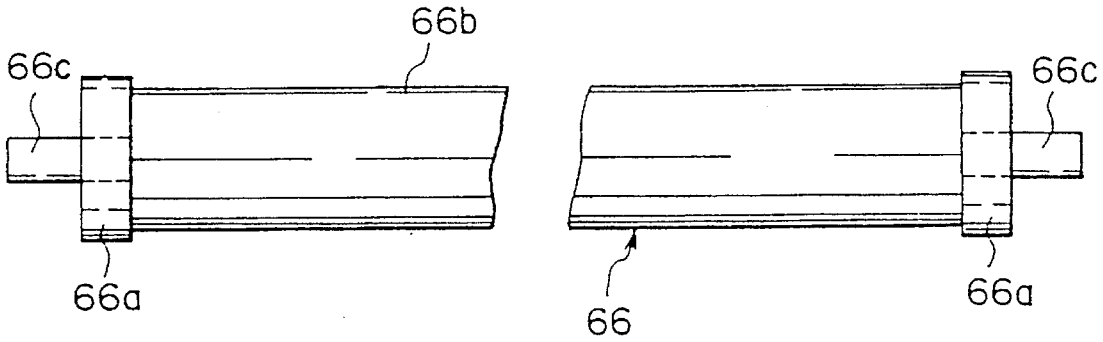
FIG. 5 is an elevation view showing a roller assembly included in the toner image transferring device of FIG. 4.

The transferring device 26 as shown in FIG. 4 is characterized in that it is provided with a roller assembly 66 including a pair of spacer rollers 66a, and a conveyer roller 66b extended therebetween, as best shown in FIG. 5. A diameter of the spacer rollers 66a is somewhat larger than that of the conveyer roller 66b, and a difference therebetween corresponds to a thickness of a paper P. The roller assembly 66 has a pair of shafts 66c protruded from the spacer rollers 66a and rotatably supported by two bearings (not shown), for example, provided in the shorter side walls of the casing 61, respectively. The transferring device 26 is also provided with another pair of spacer rollers 68 displaced at side edges of the drum 16 and rotatably supported by two bearings (not shown), for example, provided in the shorter side walls of the casing 61, respectively. The roller assembly 66 and the spacer rollers 68 may be made of a suitable plastic material. As shown in FIG. 4, two leaf springs 69 are provided in the recess 62 so that the transferring device 26 is resiliently biased toward the photosensitive drum 16, and thus the spacer rollers 66a and 68 are resiliently pressed against the surface of the drum 16 so that the clearance between the transferring device 26 and the drum 16 is kept constant even if the drum 16 does not have a perfect circular profile, to thereby ensure a stable transferring process. Note, in FIG. 4, only one of the leaf springs 69 is visible. Thus, the roller assembly 66 defines an entrance for the paper P with together the drum 16, whereas the pair of spacer rollers 68 defines an exit for the paper P together with the drum 16. During the rotation of the drum 16 in the direction indicated by an arrow in FIG. 4, the roller assembly 66 and the spacer rollers 68 are rotated counterclockwise (FIG. 4) due to the resilient engagement with the drum 16.

With the arrangement as described above, during the transferring process, the paper P is introduced from the register rollers 28 into the clearance between the photosensitive drum 16 and the transferring device 26 through the entrance formed as a nip between the drum 16 and the conveyer roller 66b, so that a portion of the paper P passing over the transfer charger 26a is in contact with the surface of the drum 16. Accordingly, although the transfer charger 26b is away from the location just below the drum 16, a desired efficiency of a transfer of a toner image from the drum 16 to the paper P can be obtained. On the other hand, since the AC charger eliminator 26b is close to the above-mentioned location, the AC charger 26b can sufficiently exhibit the ability thereof so that the paper P can be separated from the drum 16 without being entangled therewith.

Note, in FIG. 4, reference 28a indicates a paper guide plate associated with the register rollers 28.

As mentioned above, the roller assembly 66 is rotated by the rotation of the photosensitive drum 16. Accordingly, although the trailing edge of the paper P leaves the register rollers 28, the feeding of the paper P can be also carried out by the conveyer roller 66b. This produces a certain merit. In particular, to prevent an interruption of the feeding of the paper P, the leading edge of the paper must be introduced into the nip between the heat roller 30a and the backup roller 30b of the fixing device 30 before the trailing edge thereof leaves the register roller (FIG. 2). On the other hand, the fixing device 30 must be spaced apart from the printing unit 14 by a given distance so that the drum 16 is protected from being heated by the heat roller 30a of the fixing device 30. Note, deterioration of the drum 16 may be accelerated by heating the drum 16 to a high temperature. Accordingly, when a paper to be printed on has a length shorter than a distance between the register rollers 28 and the fixing device 30, a pair of additional feeder rollers must be provided between the drum 16 and the fixing device 30 to ensure the feeding of the shorter paper. Nevertheless, according to the present invention, when a paper to be printed has a minimum length longer than a distance between the roller assembly 66 and the fixing device 30, a provision of such additional feeder rollers is unnecessary.

Figure 6:
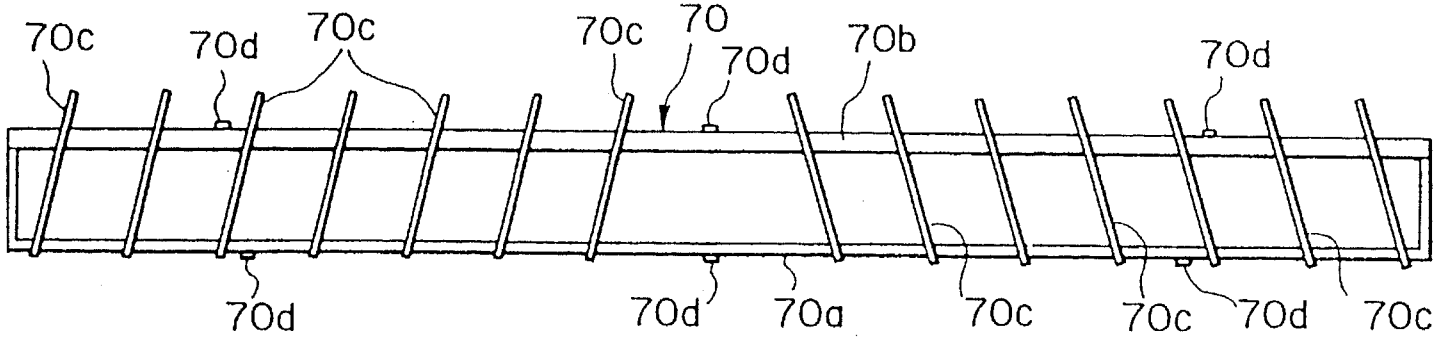
FIG. 6 is a plane view showing a paper guide assembly included in the toner image transferring device of FIG. 4.
Figure 7:
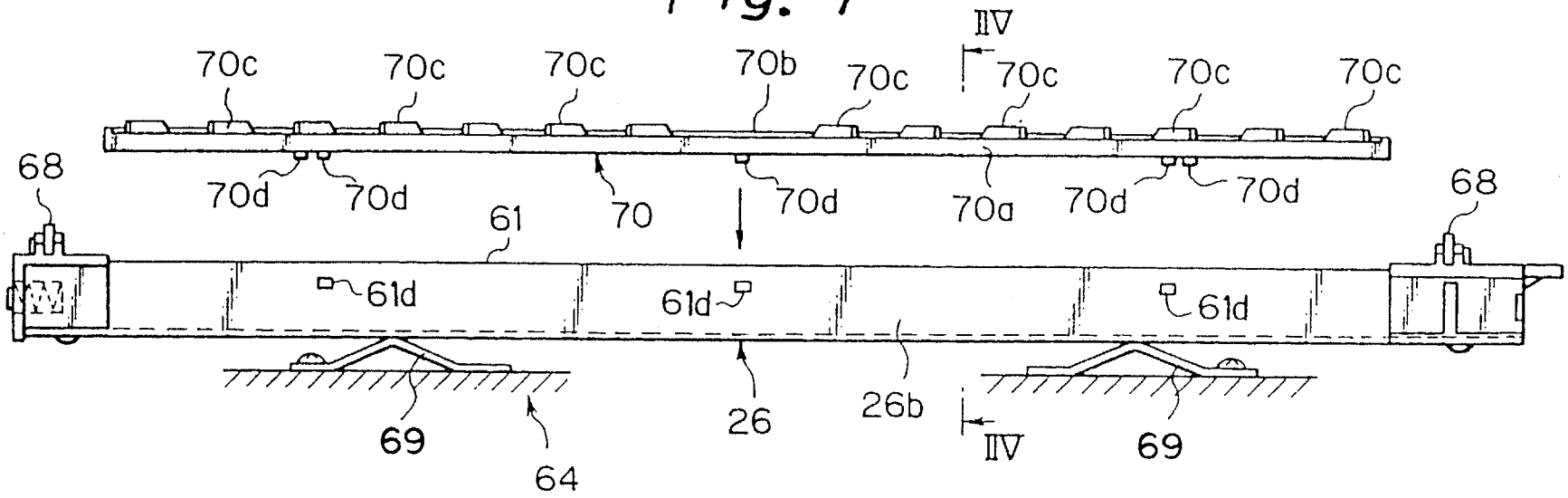
FIG. 7 is an elevation view showing an elongated box-like casing of the transferring device, together with the paper guide assembly of FIG. 6 to be mounted therein.
Figure 8:
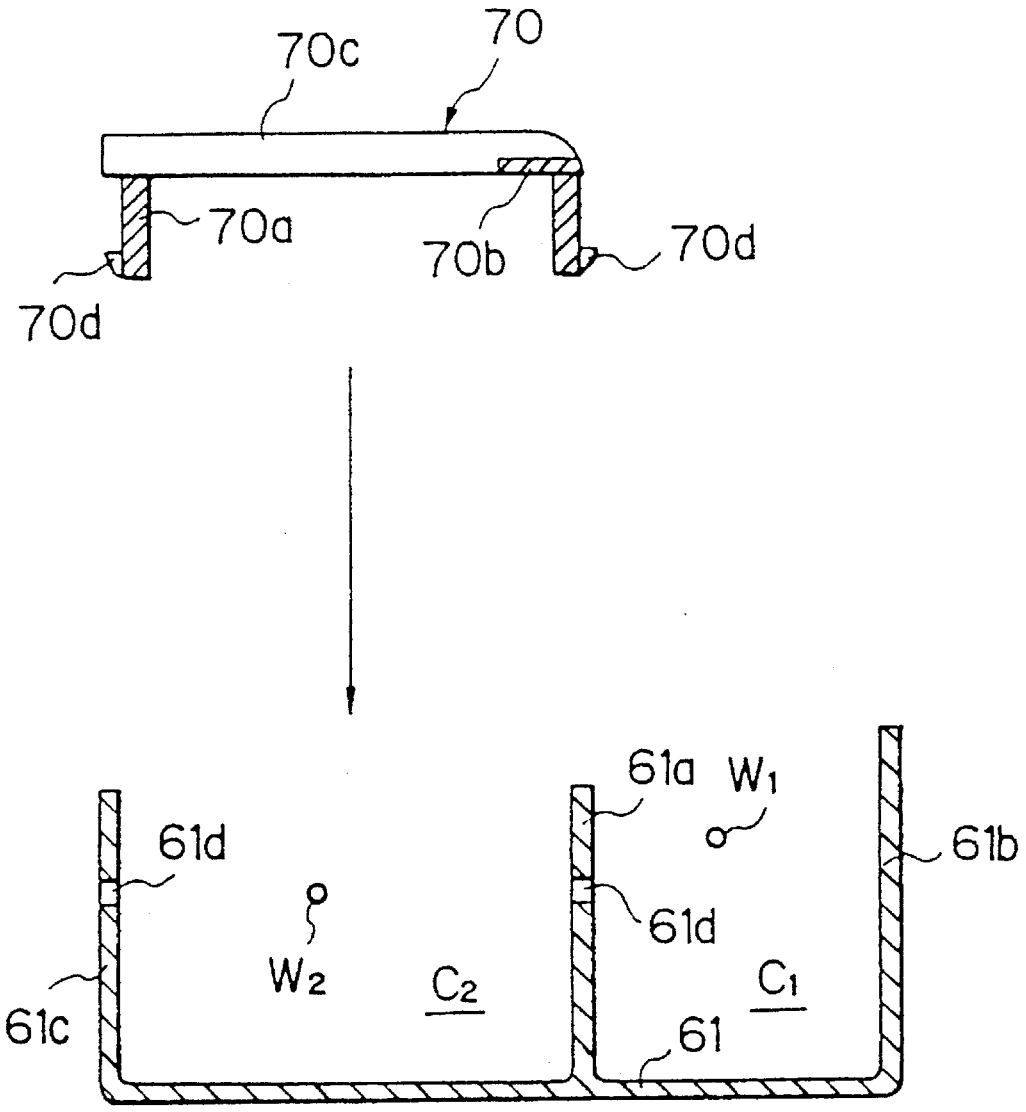
FIG. 8 is a cross-sectional view taken along line IIX—IIX of FIG. 7.

The transferring device 26 as shown in FIG. 4 is further characterized by a paper guide assembly 70 provided on the AC charge eliminator 26b. As shown in FIG. 4,6 and 7 the paper guide assembly 70 includes an elongated rectangular frame member 70a having a dimension somewhat smaller than that of an upper rectangular opening of the AC charge eliminator 26b, a strip-like plate member 70b extended along one of the longer sides of the frame member 70a, a plurality of paper guide members 70c arranged on and bridged between the strip-like plate member 70b and the other longer side of the frame member 70a. Preferably, the paper guide assembly 70 is made of a suitable plastic material as an integrally molded product. Each of the longer sides of the frame member 70a is provided with some projections 70d integrally protruded outward therefrom and suitably spaced from each other. On the other hand, each of the partition wall 61a and the longer side wall 61c has some small openings 61d formed therein, as shown in FIGS. 7 and 8. The frame member 70a of the paper guide assembly 70 is forcedly received in the rectangular opening of the AC charge eliminator 26*b*, as indicated by an arrow in FIGS. 7 and 8, in such a manner that: the projections 70*d* are snugly engaged with the small openings (61*d*) formed the partition walls 61*a* and the longer side wall 61*c*, respectively; and that the strip-like plate member 70*b* is rested on the top of the partition wall 61*a*.

Figure 9:
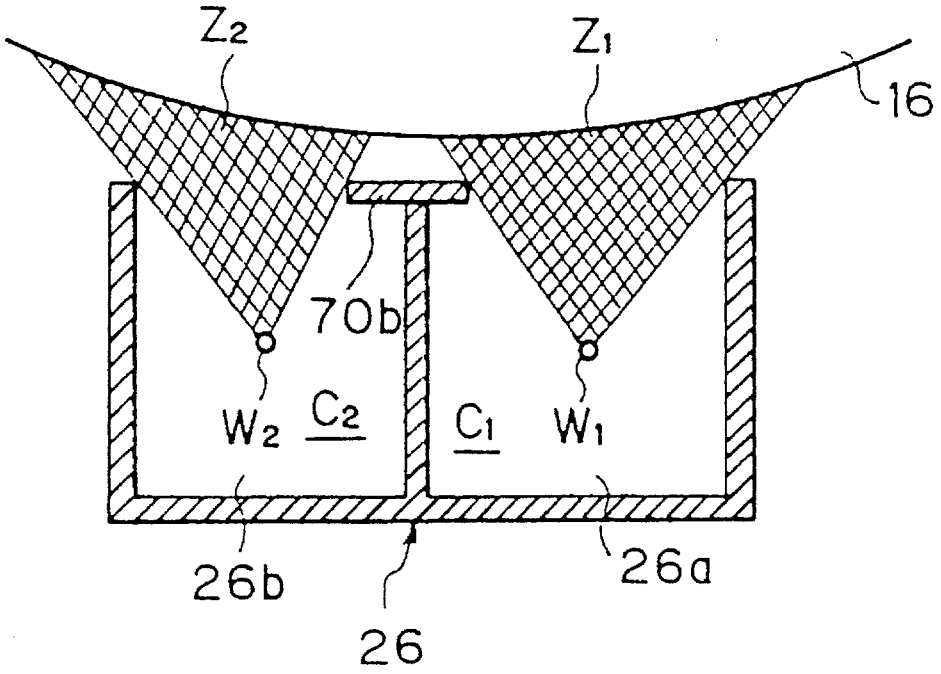
FIG. 9 is a diagrammatic view showing two cross-hatched zones on which a transfer charger and an AC charge eliminator of the transferring device produce electric effects, respectively.

The paper guide assembly 70 as mentioned above performs not only an important function for guiding the paper P with the plurality of paper guide members 70*c* thereof, but also a further important function. In particular, the strip-like plate member 70*b* of the paper guide assembly 70 serves as a blocking plate member for preventing an interference between the transfer charger 26*a* and the AC charge eliminator 26*b*. FIG. 9 diagrammatically shows two cross-hatched zones $Z_1$ and $Z_2$ on which the transfer charger 26*a* and the AC charge eliminator 26*b* produce electric effects, respectively, and the cross-hatched zones $Z_1$ and $Z_2$ are isolated from each other due to the existence of the strip-like plate member or blocking plate member 70*b*. Of course, if the cross-hatched zones $Z_1$ and $Z_2$ are overlapped with each other, the transfer charger 26*a* and the AC charge eliminator 26*b* cannot sufficiently exhibits the respective abilities thereof.

Figure 11:
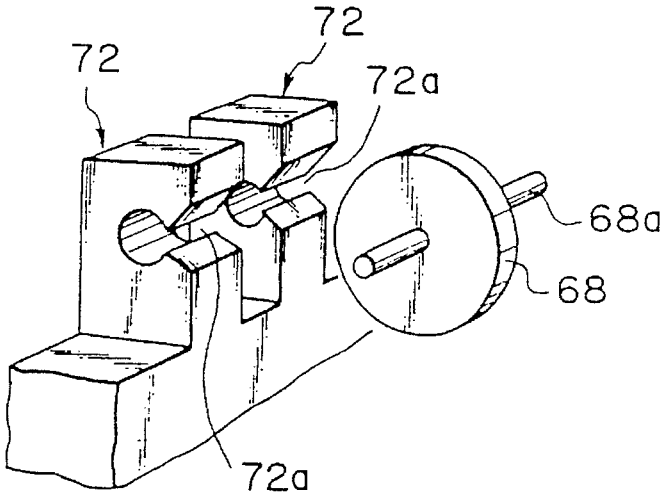
FIG. 11 is a perspective view showing a pair of bearing members for rotatably supporting a spacer roller included in the transferring device of FIG. 10.
Figure 10:
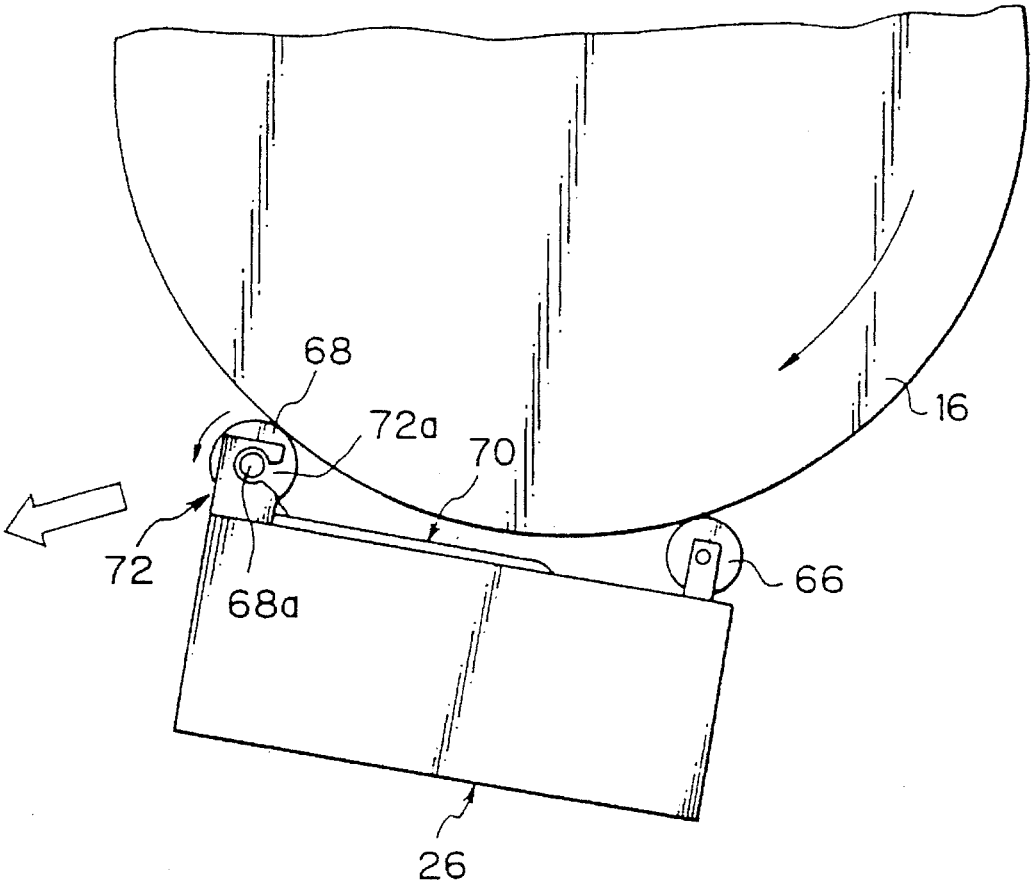
FIG. 10 is a schematic view showing a modification of the toner image transferring device of FIG. 4.

FIG. 10 shows a modification of the toner image transferring device shown in FIG. 4. Note, in FIG. 10, the features similar to those of FIG. 4 are indicated by the same references. In this modified embodiment, each of the spacer rollers 68 defining the exit for the paper is rotatably supported by a pair of bearing members 72 which may be made of a suitable plastic material, and which is securely arranged on the transferring device 26. As best shown in FIG. 11, each of the bearing members 72 has a split 72*a* formed therein and having a width somewhat smaller than a diameter of a shaft 68*a* of the spacer roller 68. A mounting of the shaft 68*a* of the spacer roller 68 in the bearing members 72 is carried out by forcedly thrusting the shaft 68*a* thereinto through the splits 72*a*. As shown in FIG. 10, the split 72*a* is oriented inward, i.e., the split 72*a* is directed to the roller assembly 66, whereby the shaft 68*a* can be stably supported by the bearing members 72 without a slippage of the same out of the bearing members 72. This is because a force exerted upon the shaft 68*a* by the photosensitive drum 16 is directed outward, as generally indicated by a hollow arrow in FIG. 10, during the rotation of the drum 16. Also, the bearing members 72 are not be susceptible to a penetration of floating toner particles produced during the transferring process. If the split 72*a* is directed upward, the floating toner particles can easily penetrate into the bearing members 72, and thus the shaft 68*a* and the bearing members 72 may be prematurely worn, because the toner particles act as an abrasive.

Figure 12:
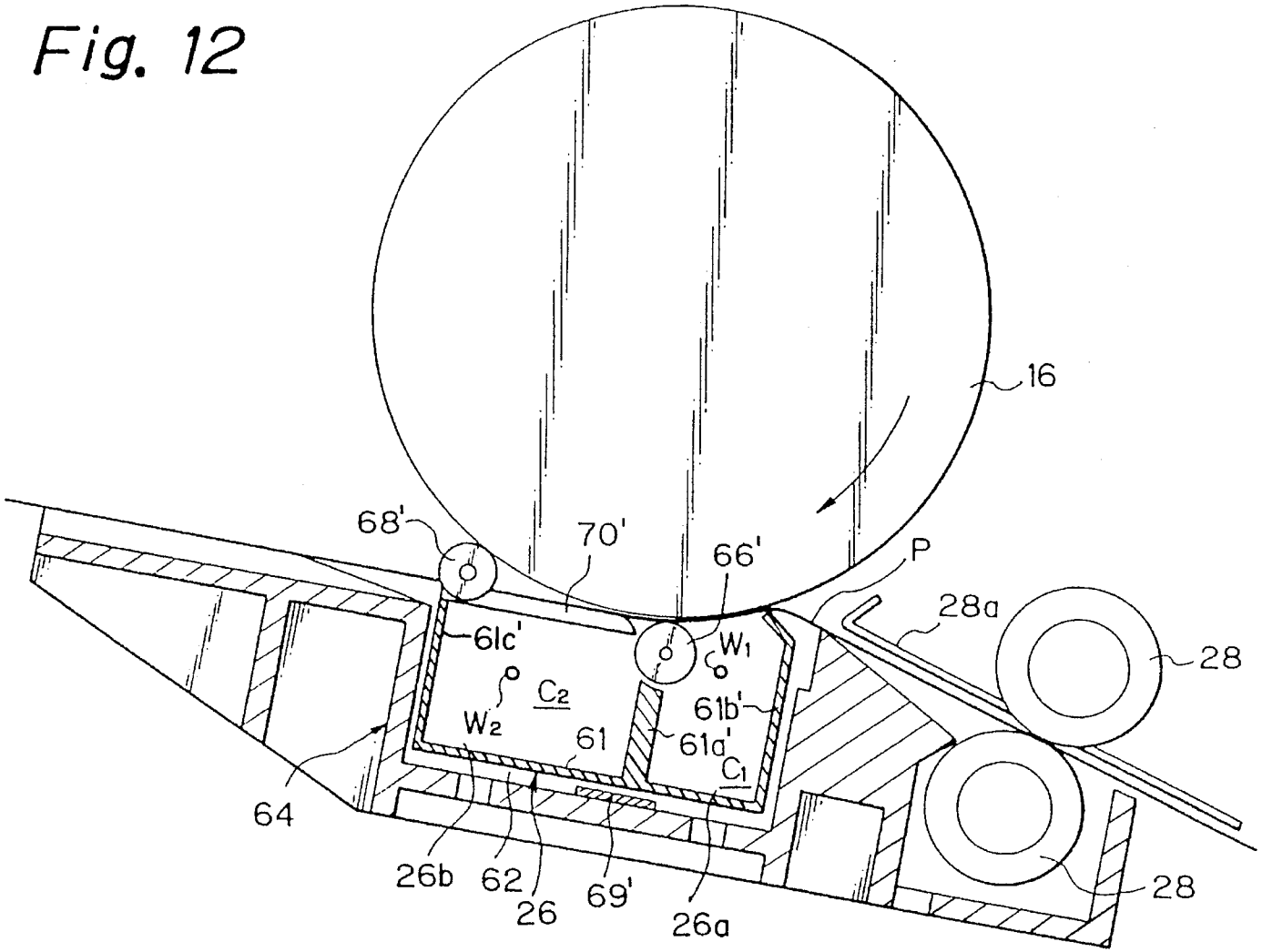
FIG. 12 is a partially-sectional and enlarged view showing a second embodiment of the toner image transferring device according to the first aspect of the present invention.

FIG. 12 shows a second embodiment of the toner image transferring device 26 constructed according to the first aspect of the present invention. Note, in FIG. 12, the features similar to those of FIG. 4 are indicated by the same references, and the features corresponding to those of FIG. 4 are indicated by the same references primed. Similar to the first embodiment, the transfer charger 26*a* and the AC charge eliminator 26*b* are integrally associated with each other. The transferring device 26 has an elongated box-like casing 61, an interior of which is divided into two chambers $C_1$ and $C_2$ by a middle partition wall 61*a*' extended between the shorter side walls (not shown in FIG. 12) of the casing 61. Namely, the chamber $C_1$ is defined by the partition wall 61*a*' and one (61*b*') of the longer side walls 61*b*' and 61*c*' of the casing 61, indicated by reference 61*b*' and the chamber $C_2$ is defined by the partition wall 61*a*' and the other longer side wall 61*c*' thereof. The casing 61 may be formed of a suitable metal material such as stainless steel. A shown in FIG. 12, two electric wires $W_1$ and $W_2$ are longitudinally extended in the chambers $C_1$ and $C_2$, respectively. Of course, the wire $W_1$ forms a part of the transfer charger 26*a*, and is connected to a suitable DC current source (not shown), whereas the wire $W_2$ forms a part of the AC charge eliminator 26*b*, and is connected to a suitable AC current source (not shown). The casing 61 of the transferring device 26 is received in a recess 62 formed in a frame 64 of the printer, and is positioned with respect to the photosensitive drum 16 so that the AC charge eliminator 26*b* is close to a location just below the drum 16, but the transfer charger 26*a* is away from that location.

Figure 13:
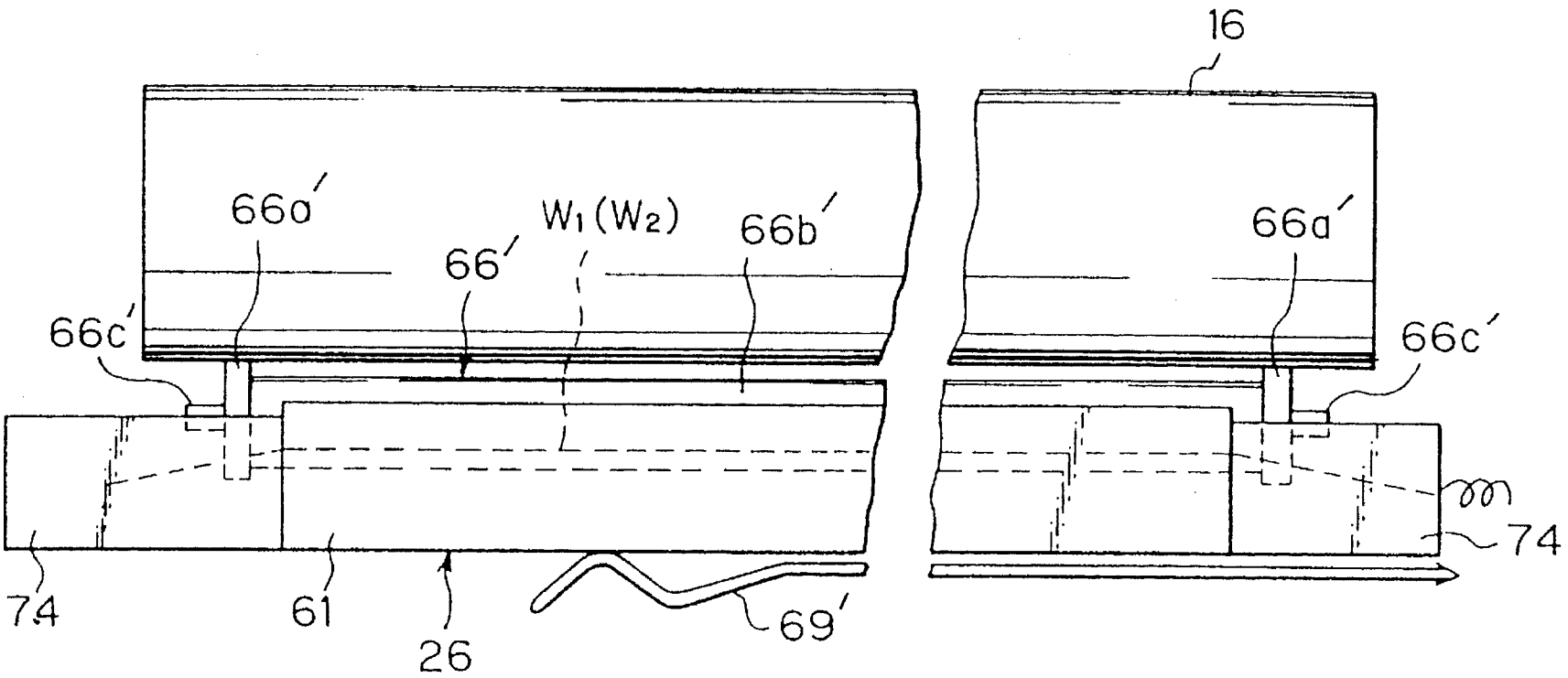
FIG. 13 is an elevational view showing the transferring device of FIG. 12 together with a photosensitive drum.

The transferring device 26 as shown in FIG. 12 is characterized in that an upper end portion of the longer side wall 61*a*' is bent inward such that a free end edge thereof is close to the surface of the photosensitive drum 16 to define an entrance for a paper P with the photosensitive drum. Also, the transferring device 26 is further characterized in that it is provided with a roller assembly 66' constituted in substantially the same manner as shown in FIG. 5. Namely, as shown in FIG. 13, the roller assembly 66' includes a pair of spacer rollers 66*a*', and a conveyer roller 66*b*' extended therebetween, and a diameter of the spacer rollers 66*a*' is somewhat larger than that of the conveyer roller 66*b*', with a difference therebetween corresponding to a thickness of a paper P. Similar to the roller assembly 66 shown in FIG. 5, the roller assembly 66' also has a pair of shafts 66*c*' protruded from the spacer rollers 66*a*'. In the second embodiment, the partition wall 61*a*' has a height lower than that of the partition wall 61*a*' of the first embodiment shown in FIG. 4, and the roller assembly 66' is disposed just above the partition wall 61*a* as if forming an upper portion thereof. Also, in this embodiment, the spacer rollers 66*a*' and the shafts 66*c*' are rotatably supported by two bearing recesses formed in block members 74 attached to the shorter side walls of the casing 61, respectively. The block members 74 may be made of a suitable dielectric material such as a plastic material, and the ends of the wire $W_1$, $W_2$ are embedded in the block members 74, respectively. As shown in FIG. 13, one end of the wire $W_1$, $W_2$ is drawn out of the corresponding block member 74, and is connected to the corresponding electric source. The transferring device 26 is also provided with another pair of spacer rollers 68' constituted and arranged in substantially the same manner as in FIG. 4, to define an exit for the paper P with the drum 16. Note, each of the spacer rollers 68' is preferably supported by the bearing member 72 as shown in FIGS. 10 and 11. A leaf spring 69' is provided in the recess 62 so that the transferring device 26 is resiliently biased toward the photosensitive drum 16, as shown in FIGS. 12 and 13, and thus the spacer rollers 66*a*' and 68' are resiliently pressed against the surface of the drum 16 so that the clearance between the transferring device 26 and the drum 16 is kept constant even if the drum 16 does not have a perfect circular profile, to thereby ensure a stable transferring process. During the rotation of the drum 16 in the direction indicated by an arrow in FIG. 12, the roller assembly 66' and the spacer rollers 68' are rotated counterclockwise (FIG. 12) due to the resilient engagement with the drum 16.

Note, in FIG. 12, reference 70' indicates a plurality of paper guide members extended from the top of the longer side wall 61*c*' of the casing 61, and only one of the paper guide members 70' is visible in this drawing.

With the arrangement as described above, during the transferring process, the paper P is introduced from the register rollers 28 into the clearance between the photosensitive drum 16 and the transferring device 26 through the entrance formed between the surface of the drum 16 and the upper free end edge of the longer side wall 61*b*' of the casing 61, so that a portion of the paper P passing over the transfer charger 26*a* is in contact with the surface of the drum 16. Accordingly, although the transfer charger 26*b* is away from the location just below the drum 16, a desired efficiency of a transfer of a toner image from the drum 16 to the paper P can be obtained, On the other hand, since the AC charger eliminator 26*b* is close to the above-mentioned location, the AC charger 26*b* can sufficiently exhibit the ability thereof so that the paper P can be separated from the drum 16 without being entangled therewith.

In the second embodiment as shown in FIG. 12, a distance between the roller assembly 66' and the fixing device 30 is shorter than that between the roller assembly 66 and the fixing device 30 (FIG. 4). Accordingly, in comparison with the first embodiment, a feeding of a paper having a shorter length can be carried out without providing a pair of additional feeder rollers between the drum 16 and the fixing device 30 to ensure the feeding of the shorter paper. Also, the roller assembly 66' can serve as a blocking member for preventing interference between the transfer charger 26*a* and the AC charge eliminator 26*b*.

Furthermore, the transferring device 26 as shown in FIG. 12 exhibits a noticeable merit for a case where the printer is constituted such that printing can be done on both side faces of a paper, as shown in FIGS. 1 and 2. In particular, the roller assembly 66 of the first embodiment (FIG. 4) is electrically charged by the transfer charger 26*a*, so that toner particles are electrostatically adhered to the conveyer roller 66*b* of the roller assembly 66, and thus an underside of the paper is stained with the toner particles adhered to the conveyer roller 66*b*. Accordingly, when the printing is done on both the side faces of paper, the toner staining appears on the printed side faces of paper. Nevertheless, in the second embodiment (FIG. 12), the toner staining can be prevented because the charge of the roller assembly 66' caused by the transfer charger 26*a* can be eliminated by the AC charge eliminator.

Figure 14:
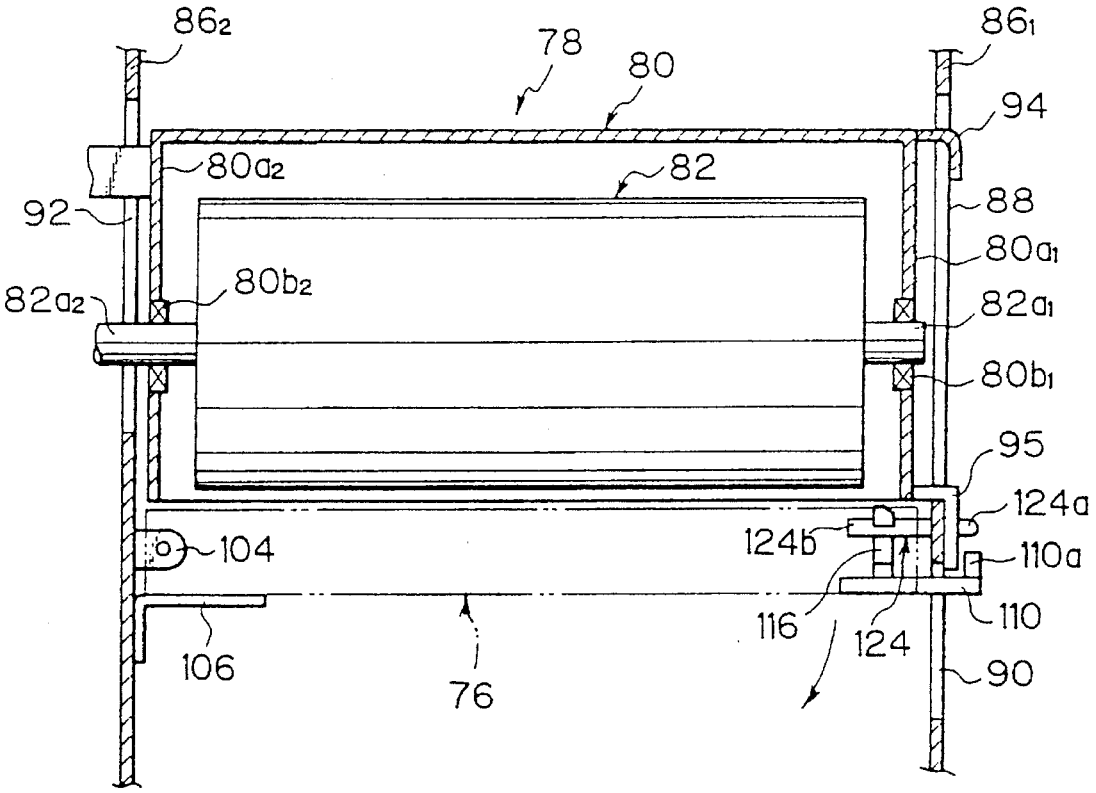
FIG. 14 is a partially-sectional and enlarged view showing an embodiment of an arrangement of a printing unit including a toner image transferring device, constituted according to a second aspect of the present invention.

FIGS. 14 to 19 show a toner image transferring device 76 constituted according to a second aspect of the present invention, which may be incorporated in the printer as shown in FIGS. 1 and 2. In FIG. 14, only a profile of the transferring device 76 is shown by a phantom line, and reference 78 indicates a printing unit including a movable casing 80, a bottom of which is opened. The printing unit 78 also includes a photosensitive drum 82 housed in the casing 80 and having shaft portions $82a_1$ and $82a_2$ protruded from the end faces thereof, respectively. The shaft portions $82a_1$ and $82a_2$ are rotatably supported by two bearings $82b_1$ and $82b_2$ mounted in the end walls $80a_1$ and $80a_2$ of the movable casing 80, respectively. Although not illustrated in FIG. 14, the printing unit 78 further includes elements corresponding to the electric discharger 18, and the developing device 22 as shown in FIG. 2.

Figure 15:
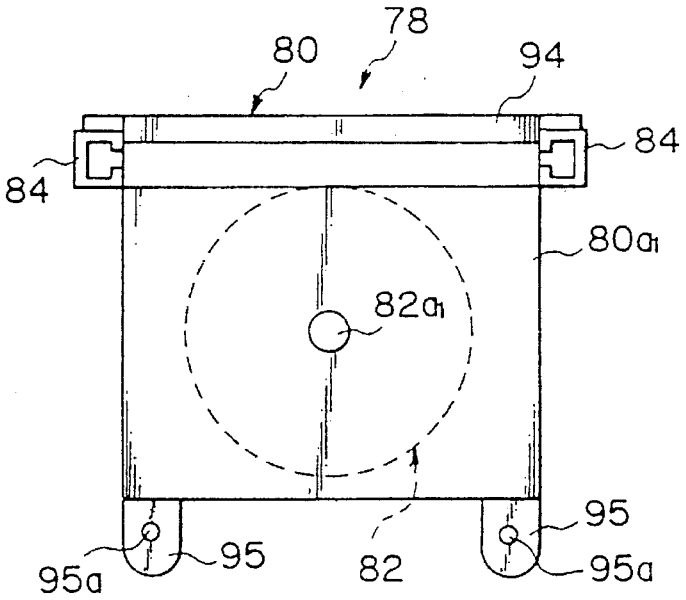
FIG. 15 is a front view of a printing unit of FIG. 14.
Figure 16:
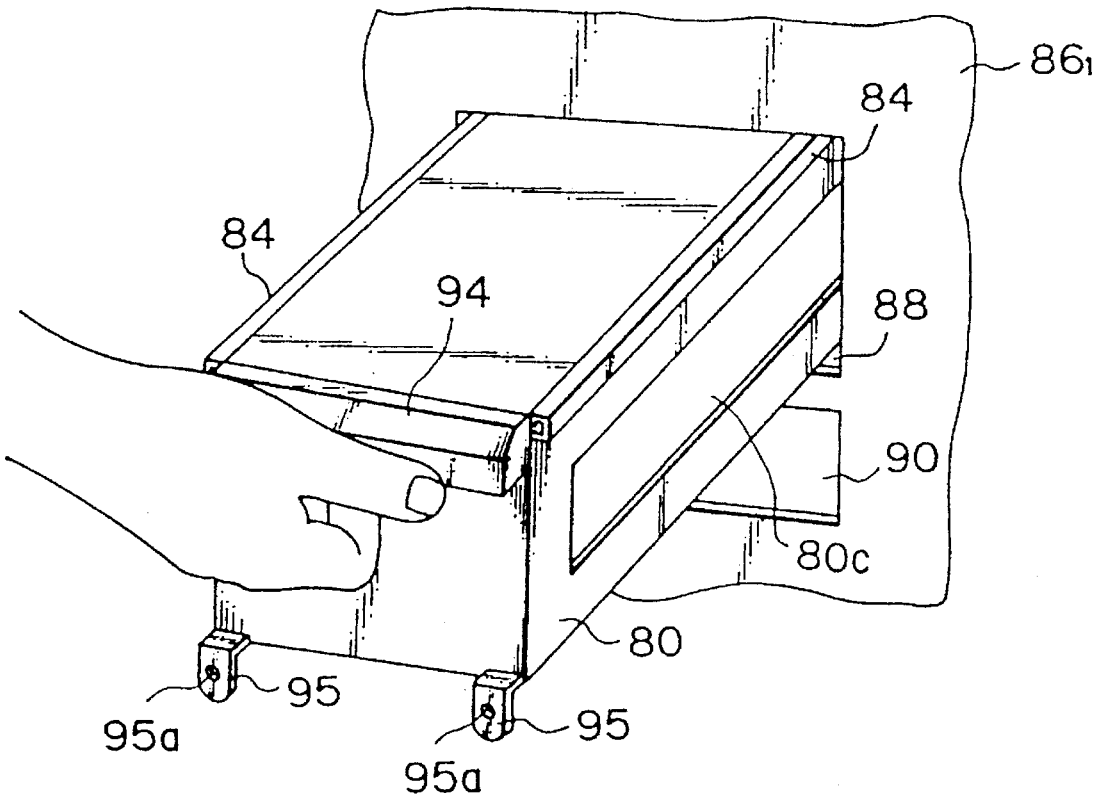
FIG. 16 is a perspective view of the printing unit of FIG. 14, taken out of a printer frame.

As shown in FIGS. 15 and 16, the movable casing 80 has a pair of rail members 84 extended along and fixed to opposed upper side edges thereof, and is movably supported by the aid of the rail members 84. In particular, the rail members 84 ride on two arrays of guide rollers (not shown) arranged at fixed positions therealong and extended between two spaced plate-like frame members $86_1$ and $86_2$. The plate-like frame member $86_1$ is accessible by opening a movable door provided in a printer housing (not shown), and has two openings 88 and 90 formed therein, and the plate-like frame member $86_2$ has an opening 92 formed therein. The casing 80 has a handle 94 provided along an upper side edge of the end wall $80a_1$ thereof, whereby the casing 80 can be manually taken out of the printer housing through the opening 88 of the plate-like frame member $86_1$, as shown in FIG. 16. When the casing 80 is positioned between the plate-like frame members $86_1$ and $86_2$, the shaft portion $82a_2$ of the drum 82 is extended through the opening 92 of the plate-like frame member $86_2$. Although not illustrated in FIG. 14, the shaft portion $82a_2$ is provided with a coupling element at a free end thereof, with the coupling element being engageable with an output shaft of a drive motor (not shown). Also, the casing 80 is provided with a pair of tongue elements 95 extended from a lower side edge of the end wall $80a_1$ thereof and bent downward at a right angle, and each of the tongue elements 95 has a positioning hole 95*a* formed therein. Note, in FIG. 16, reference 80*c* indicates an elongated opening formed in a longer side wall of the casing 80, and a developing roller of the developing device faces the surface of the drum 82 through the opening 80*c*.

Figure 17:
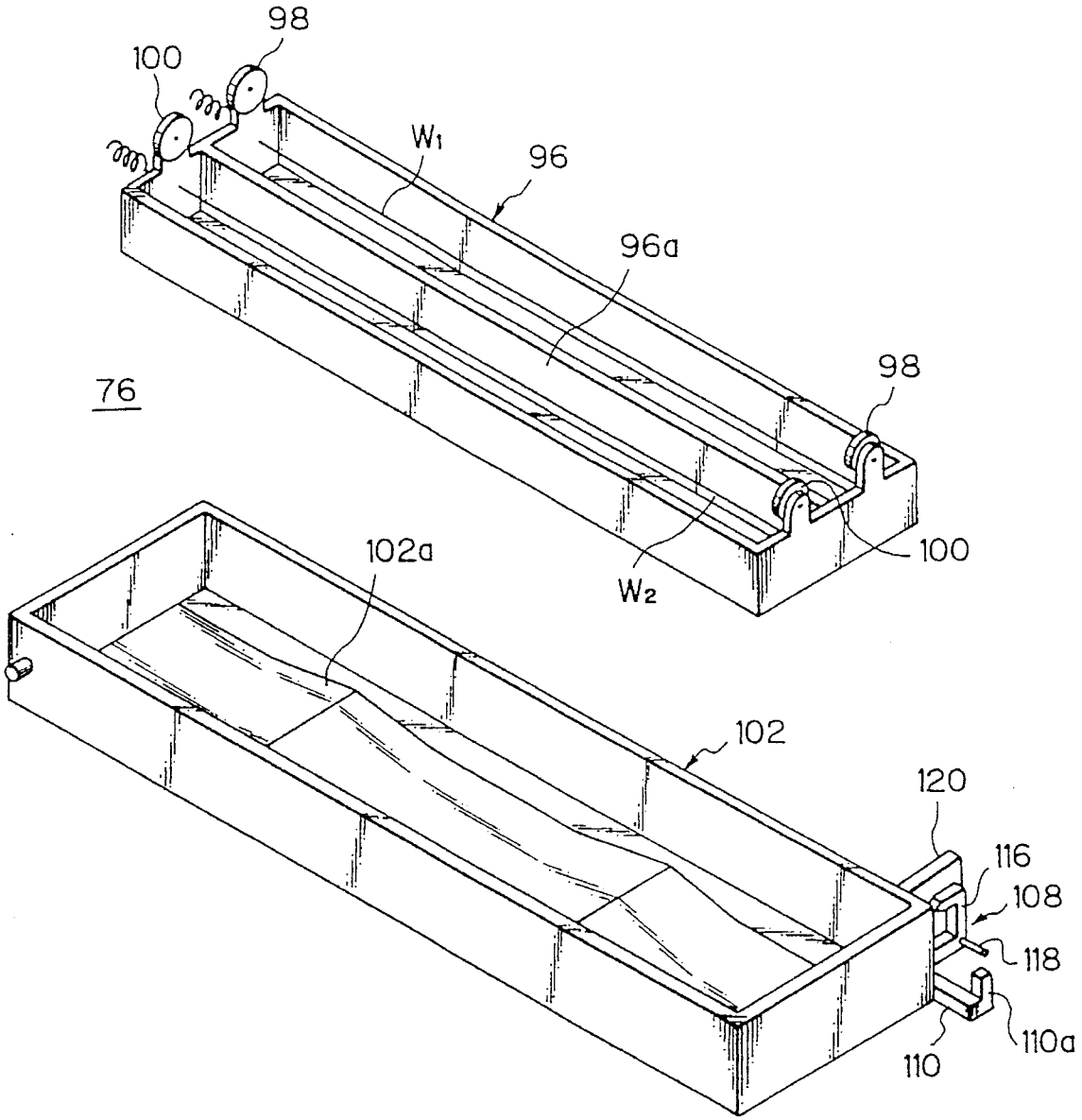
FIG. 17 is an exploded perspective view of the toner image transferring device forming a part of the printing unit of FIG. 14.

The toner image transferring device 76 forms a part of the printing unit 78, and includes an elongated box-like casing 96, as shown in FIG. 17. An interior of the casing 96 is divided into two chambers $C_1$ and $C_2$ by a middle partition wall 96*a* extended between the shorter side walls of the casing 96. Namely, the chamber $C_2$ is defined by the partition wall 96*a* and one of the longer side walls of the casing 96, and the chamber $C_2$ is defined by the partition wall 96*a* and the other longer side wall thereof. Two electric wires $W_1$ and $W_2$ are longitudinally extended in the chambers $C_1$ and $C_2$, and are connected to a suitable DC current source (not shown) and a suitable AC current source (not shown), respectively, whereby a transfer charger and an AC charge eliminator are formed in the casing 96 and are integrally associated with each other. As shown in FIG. 17, two sets of spacer rollers 98 and 100 are provided on the shorter side walls of the casing 96.

The transferring device 76 also includes an elongated box-like container 102 for receiving the casing 96, and a leaf spring 102*a* provided on a bottom of the container 102. Two pivot pins 102*b* (only one is visible in FIG. 17) are protruded from the longer side walls of the container at a rear end thereof, and is rotatably inserted into pivot holes formed in two spaced tongue-like elements 104 (only one is visible in FIG. 14) protruded from the plate-like frame member $86_2$, respectively. As shown in FIG. 14, an L-shaped leaf spring 106 is fixed to the plate-like frame member $86_2$ to support the rear end portion of the container 102.

Figure 18:
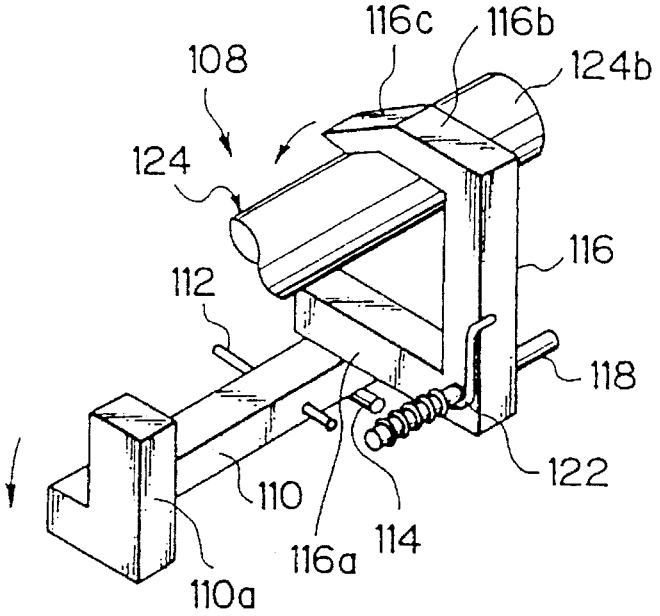
FIG. 18 is a perspective view of a locking mechanism provided on the toner image transferring device of FIG. 14.

The transferring device 76 further includes a locking mechanism 108 provided on one of the longer side walls of the container 102 at a front end thereof. In particular, as shown in FIG. 18, the locking mechanism 108 includes a lever member 110 pivoted on a pivot pin element 112 protruded from the corresponding longer side wall of the container 102. The lever member 110 has an upright projection 110*a* integrally formed at an outer end thereof, and an inner end thereof being rested on a stop pin 114 protruded from the corresponding longer side wall of the container 102. The locking mechanism 108 also includes a generally U-shaped lock lever member 116 pivoted on a pivot pin element 118 which is protruded from a support plate member 120 (FIG. 17) perpendicularly extended from the corresponding longer side wall of the container 102. A torsion spring 122 acts between the lock lever member 116 and the pivot pin element 118 so that the lock lever member 116 is resiliently biased in a rotational direction indicated by an arrow in FIG. 18, whereby a lower leg portion 116*a* of the U-shaped lock lever member 116 is resiliently rested on the inner end of the lever member 110. An upper leg portion 116*b* of the lock lever member 116 is shaped as a hook-shaped portion having a slanted face 116*c* formed on an upper side thereof.

A pin member 124 is passed through the plate-like frame member $\mathbf{86}_1$ between the openings 88 and 90 formed therein, and is securely fixed to the plate-like frame member $\mathbf{86}_1$. Namely, the pin member 124 has an outer portion 124*a* protruded outward from the plate-like frame member $\mathbf{86}_1$, and an inner portion 124*b* protruded inward therefrom, as shown in FIG. 14. Although not illustrated, another pin member similar to the outer portion 124*a* is protruded from the plate-like frame member $\mathbf{86}_1$ between the openings 88 and 90. When the casing 80 is positioned between the plate-like frame members $\mathbf{86}_1$ and $\mathbf{86}_2$, as shown in FIG. 14, the outer portion 124*a* and the not illustrated pin member are inserted into the holes 95*a* of the tongue elements 95, respectively, whereby the casing 80 can be exactly positioned in place.

Figure 19:
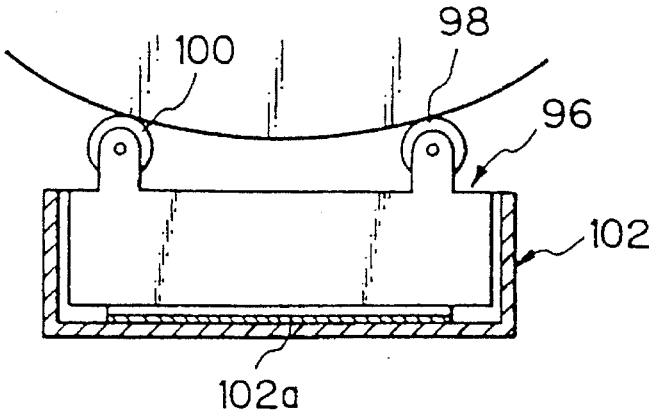
FIG. 19 is a partially-sectional view showing a positional relationship between a photosensitive drum and the toner image transferring device of FIG. 14.

When the inner portion 124*b* of the pin member 124 is engaged with the hook-shaped portion 116*b* of the lock lever member 116, as shown in FIGS. 14 and 18, the transferring device 76 is maintained at an operating position, as shown by the phantom line in FIG. 14. Namely, the casing 96 is resiliently biased toward the photosensitive drum 16 by the leaf spring 102*a*, so that the spacer rollers 98 and 100 are resiliently pressed against the surface of the drum 16, as shown in FIG. 19. Thus, a clearance between the transferring device 76 and the drum 16 is kept constant even if the drum 16 does not have a perfect circular profile, whereby a stable transferring process can be ensured.

When the transferring device 76 is maintained at the operation position, the upright projection 110*a* of the lever member 110 is projected outward through the opening 90, such that the corresponding tongue element 95 is penetrated into a space between the plate-like frame member $\mathbf{86}_1$ and the upright projection 110*a*, as shown in FIG. 14. Accordingly, when the casing 80 is manually taken out of the printer housing through the opening 88 of the plate-like frame member $\mathbf{86}_1$, as shown in FIG. 16, the lever member 110 is rotated due to the engagement with the corresponding tongue element 95 in a rotational direction indicated by an arrow in FIG. 18, so that the lock lever member 116 is rotated against the resilient force of the torsion spring 122. Thus, the lock lever member 116 is disengaged from the inner portion 124*b* of the pin member 124, so that the transferring device 76 is rotated in a rotational direction indicated by an arrow in FIG. 14, due to the force of gravity, but the transferring device 76 is held at a tilted position by the leaf spring 106. Accordingly, an easy access for maintenance of the printing unit 78 including the transferring device 76 is possible.

All things considered, with the arrangement as shown in FIGS. 14 to 19, not only can an establishment of constant clearance between the transferring device 76 and the drum 82 be ensured for maintaining a stable transferring process, but also the maintenance of the printing unit 78 including the transferring device can be easily carried out.

Of course, the features as stated with reference to FIGS. 4 and 12 may be incorporated in the embodiment shown in FIG. 14 to 19. For example, a roller assembly (66) as shown in FIG. 5 may be substituted for the pair of spacer rollers 98. Also, each of the spacer rollers 98, 100 may be rotatably supported by the bearings as shown in FIGS. 10 and 12.

Finally, it will be understood by those skilled in the art that the foregoing description is of preferred embodiments of the present invention, and that various changes and modifications can be made without departing from the spirit and scope thereof.

We claim:

1. A toner image transferring device for electrostatically transferring a charged toner image from a toner image carrying body to a sheet of paper, which comprises:

transfer charger means, disposed in a vicinity of said carrying body so as to form a clearance therebetween, for giving the sheet of paper an electric charge having a polarity opposite to that of the charged toner image while the sheet of paper is passed therethrough;

separation means for separating the sheet of paper from said carrying body, said separation means supplying electric charges to the sheet of paper for effecting separation of the sheet of paper from said carrying body; and spacer means for maintaining a constant clearance between said image carrying body and said transferring device, said spacer means including:

spring means for resiliently urging said transferring means to said carrying body, a pair of spacer rollers, each of the spacer rollers having two shaft portions extending oppositely and axially outwardly from the spacer rollers, and a pair of bearing members, each of the bearing members having a split through which a corresponding shaft portion of the spacer roller is forced, said split being oriented in a direction counter to the feeding direction of the sheet of paper.

2. An image forming apparatus comprising:

a toner image carrying body;

a toner image transferring device for electrostatically transferring a charged toner image from said carrying body to a sheet of paper;

casing means for rotatably supporting said carrying body therein about a first axis of said carrying body, said casing means being movable between an operative position and a non-operative position in a direction parallel with the first axis of said carrying body, said casing means having a contacting portion;

positioning means for positioning said casing means at the operative position thereof;

container means for receiving said transferring device, said container means being movable between an operative position and a non-operative position which is downwardly away from the operative position;

locking means for locking said container means to said casing means at the operative position thereof, said locking means including:

a pin member protruding from said casing means in a direction parallel with the first axis; and a lock lever, supported on said container means, for locking said container means to said casing means, said lock lever being rotatable about a second axis extending in a direction parallel with the first axis;

releasing means for releasing said container means from said casing means, said releasing means including a lever member, supported on said container means and having a contacted portion which is in contact with the contacting portion of said casing means, for causing the lock lever to rotate about the second axis while said casing means moves from the operative position to the non-operative position; and spacer means for maintaining a constant clearance between said carrying body and said transferring device in the operative position thereof.

3. An image forming apparatus as set forth in claim 2, wherein said container means is angularly moved between the operative position and the non-operative position.

4. An image forming apparatus as set forth in claim 3, wherein said container means is resiliently supported by a resilient member at the non-operative position.

5. A toner image transferring device for electrostatically transferring a charged toner image to a sheet of paper, comprising:

an image carrying body which carries the charged toner image;

a transfer charger forming a charging area with the image carrying body, the charging area having an inlet and an outlet, the sheet of paper being received in the inlet of the charging area, passed through the charging area, and output at the outlet of the charging area, the transfer charger and the image carrying body being positioned so that the image carrying body has a contact zone which contacts the sheet of paper when the sheet of paper is passed through the charging area, the contact zone having a lowest point thereon, the transfer charger providing the sheet of paper with an electric charge as the sheet of paper is passed through the charging area to transfer the charged toner image from the image carrying body to the sheet of paper as the sheet of paper is passed through the charging area, a leading edge of the sheet of paper being in contact with the contact zone of the image carrying body as the sheet of paper is passed through the charging area;

a charge eliminator which partially eliminates electric charge from the sheet of paper as the sheet of paper is passed through the charging area so that the leading edge of the sheet of paper is separated from the image carrying body at the outlet of the charging area, the charge eliminator being positioned directly below the lowest point of the contact zone of the image carrying body, the transfer charger being positioned adjacent to the charge eliminator and not being directly below the lowest point of the contact zone, and the charge eliminator being closer to the image carrying body than the transfer charger is to the image carrying body; and a paper entrance mechanism, positioned at the inlet of the charging area, which regulates the position of the sheet of paper to contact the sheet of paper with the image carrying body at the inlet of the charging area and improve the efficiency of the transfer of the charged toner image from the image carrying body to the sheet of paper.

6. A toner image transferring device as set forth in claim 5, further comprising:

a roller assembly located at the inlet of the charging area, the roller assembly including a pair of spacer rollers, and a paper conveyer roller extended between the pair of spacer rollers, the diameter of the paper conveyer roller being smaller than the diameter of the pair of spacer rollers.

7. A toner image transferring device as set forth in claim 6, wherein transfer charger comprises:

means for resiliently biasing the transfer charger toward the carrying body so that the spacer rollers of the roller assembly are resiliently pressed against the surface of the image carrying body.

8. A toner image transferring device as set forth in claim 6, wherein the charge eliminator has an inlet and an outlet and comprises:

a pair of spacer rollers disposed at the outlet of the charge eliminator; and means for biasing the pair of spacer rollers toward the image carrying body.

9. A toner image transferring device as set forth in claim 6, wherein the charge eliminator includes a discharger having a discharge wire, and the transfer charger includes a charger having a charger wire, the toner image transferring device further comprising:

a casing which holds the discharge wire of the discharger and the charger wire of the charger;

a pair of casing spacer rollers, different from the pair of spacer rollers of the roller assembly, disposed on said casing; and means for biasing the casing toward the image carrying body such that the pair of casing spacer rollers is in contact with the image carrying body.

10. A toner image transferring device as set forth in claim 9, wherein the casing includes:

a partition wall located at a center of the casing such that the casing is partitioned into a discharging area of the discharge wire of the discharger and a charging area of the charger wire of the charger, the charging area of the charging wire of the charger being the charging area of the formed by the transfer charger.

11. A toner image transferring device as set forth in claim 10, wherein the casing includes:

a paper guide assembly displaced from the partition wall; and a blocking member for preventing overlapping a corona discharge from the discharger and a corona charge from the charger.

12. A toner image transferring device as set forth in claim 11, wherein the paper guide assembly and the blocking member are formed as an integral member made of a plastic material.

13. A toner image transferring device for electrostatically transferring a charged toner image to a sheet of paper, comprising:

an image carrying body which carries the charged toner image;

a transfer charger forming a charging area with the image carrying body, the charging area having an inlet and an outlet, the sheet of paper being received in the inlet of the charging area, passed through the charging area, and output at the outlet of the charging area, the transfer charger providing the sheet of paper with an electric charge as the sheet of paper is passed through the charging area to transfer the charged toner image from the image carrying body to the sheet of paper as the sheet of paper is passed through the charging area, a leading edge of the sheet of paper being in contact with the image carrying body as the sheet of paper is passed through the charging area;

a charge eliminator, having an inlet and an outlet and positioned to partially eliminate electric charge from the sheet of paper as the sheet of paper is passed through the charging area of the transfer charger, which receives the sheet of paper at the inlet of the charge eliminator, partially eliminates electric charge from the sheet of paper as the sheet of paper is passed through the charging area of the transfer charger so that the leading edge of the sheet of paper is separated from the image carrying body at the outlet of the charging area, and then outputs the sheet of paper at the outlet of the charge eliminator;

a roller assembly disposed at the outlet of the charge eliminator and including a pair of spacer rollers having two shaft portions outwardly protruding therefrom;

means for resiliently biasing the transfer charger toward the image carrying body so that the spacer rollers of the roller assembly are resiliently pressed against the surface of the image carrying body, wherein the charge eliminator includes a pair of bearing members provided on the charge eliminator for rotatably supporting the shaft portions of the spacer rollers respectively, each of the bearing members having a split through which a corresponding shaft portion of the spacer roller is forced, the split being oriented to prevent a slippage of the shaft portion out of the bearing member.

14. A toner image transferring device as set forth in claim 13, wherein the roller assembly further comprises:

a paper conveyer roller extended between the pair of spacer rollers, the diameter of the paper conveyer roller being smaller than the diameter of the spaced rollers of the pair of spacer rollers.

15. A toner image transferring device as set forth in claim 13, wherein:

the transfer charger and the image carrying body are positioned so that the image carrying body has a contact zone which contacts the sheet of paper when the sheet of paper is passed through the charging area, the contact zone being an arc having a lowest point thereon, the charge eliminator being positioned below the lowest point of the contact zone of the image carrying body, and the transfer charger being positioned adjacent to the charge eliminator and not being below the lowest point of the contact zone.

16. A toner image transferring device as set forth in claim 15, further comprising:

paper entrance means, positioned at the inlet of the charging area, for regulating the sheet of paper so that the sheet of paper is in contact with the image carrying body at the inlet of the charging area, thereby optimizing the efficiency of image transfer from the image carrying body to the sheet of paper.

17. A toner image transferring device as set forth in claim 16, wherein the paper entrance means further comprises:

a side wall which forms a part of the transfer charger, the side wall having an upper free end edge positioned so that the paper entrance for the sheet of paper is formed between the upper free end edge of the side wall and a surface of the image carrying body.

18. A toner image transferring device as set forth in claim 17, wherein:

each of the spacer rollers of the charge eliminator has two shaft portions outwardly protruding therefrom; and the charge eliminator includes a pair of bearing members provided on the charge eliminator for rotatably supporting the shaft portions of the spacer rollers respectively, each of the bearing members having a split through which a corresponding shaft portion of the spacer roller is forced, the split being oriented to prevent a slippage of said shaft portion out of the bearing member.

19. A toner image transferring device for electrostatically transferring a charged toner image to a sheet of paper, comprising:

an image carrying body which carries the charged toner image;

a transfer charger forming a charging area with the image carrying body, the charging area having an inlet and an outlet, the sheet of paper being received in the inlet of the charging area, passed through the charging area, and output at the outlet of the charging area, the transfer charger providing the sheet of paper with an electric charge as the sheet of paper is passed through the charging area to transfer the charged toner image from the image carrying body to the sheet of paper as the sheet of paper is passed through the charging area, a leading edge of the sheet of paper being in contact with the image carrying body as the sheet of paper is passed through the charging area;

a charge eliminator, having an inlet and an outlet and positioned to partially eliminate electric charge from the sheet of paper as the sheet of paper is passed through the charging area of the transfer charger, which receives the sheet of paper at the inlet of the charge eliminator, partially eliminates electric charge from the sheet of paper as the sheet of paper is passed through the charging area of the transfer charger so that the leading edge of the sheet of paper is separated from the image carrying body at the outlet of the charging area, and then outputs the sheet of paper at the outlet of the charge eliminator, the charge eliminator including a pair of spacer rollers disposed at the outlet of the charge eliminator;

a casing which holds the charge eliminator and the transfer charger, the casing having a partition wall provided as a boundary between the charge eliminator and the transfer charger;

a roller assembly which includes a pair of spacer rollers and a paper conveyer roller extended between the pair of spacer rollers, the diameter of the paper conveyer roller being smaller than the diameter of the pair of spacer rollers;

means for biasing the casing toward the image carrying body so that the pair of spacer rollers of the roller assembly and the pair of spacer rollers of the charge eliminator are resiliently pressed against the surface of the image carrying body; and a paper entrance mechanism, positioned at the inlet of the charging area, for regulating the sheet of paper so that the sheet of paper is in contact with the image carrying body at the inlet of the charging area, the paper entrance mechanism including a side wall which forms a part of the transfer charger, the side wall having an upper free end edge positioned so that an entrance for the sheet of paper is formed between the upper free end edge of the wall and a surface of the image carrying body.

20. A toner image transferring device as set forth in claim 19, wherein:

the transfer charger and the image carrying body are positioned so that the image carrying body has a contact zone which contacts the sheet of paper when the sheet of paper is passed through the charging area, the contact zone being an arc having a lowest point thereon, the charge eliminator being positioned below the lowest point of the contact zone of the image carrying body, and the transfer charger being positioned adjacent to the charge eliminator and not being below the lowest point of the contact zone.

21. A toner image transferring device as set forth in claim 19, wherein:

each of the spacer rollers of the charge eliminator has two shaft portions outwardly protruding therefrom; and the charge eliminator includes a pair of bearing members provided on the charge eliminator for rotatably supporting the shaft portions of the spacer rollers respectively, each of the bearing members having a split through which a corresponding shaft portion of the spacer roller is forced, the split being oriented to present a splippage of the shaft portion out of the bearing member.

22. A toner image transferring device as set forth in claim 19, wherein the roller assembly serves as a blocking member for preventing an interference between the transfer charger and the charge eliminator.

* * * * *

UNITED STATES PATENT AND TRADEMARK OFFICE

CERTIFICATE OF CORRECTION

PATENT NO. : 5,581,338

DATED : December 3, 1996

INVENTOR(S) : Kiyoshi NAKAMICHI et al.

It is certified that error appears in the above-indentified patent and that said Letters Patent is hereby corrected as shown below:

Title Page, Item [75], line 3, change "Kanagawa" to "Kawasaki"

Col. 6, line 21, change "0n" to "On"

Col. 8, line 34, change "0n" to "On"

line 51, insert --,-- after "7"

Signed and Sealed this

Tenth Day of June, 1997

*Attest:*

*Attesting Officer*

BRUCE LEHMAN

*Commissioner of Patents and Trademarks*